US012050033B2

(12) United States Patent
Kim et al.

(10) Patent No.: US 12,050,033 B2
(45) Date of Patent: Jul. 30, 2024

(54) REFRIGERATOR FOR DRINKS

(71) Applicant: LG ELECTRONICS INC., Seoul (KR)

(72) Inventors: Dae Woong Kim, Seoul (KR); Hee Su Yang, Seoul (KR); Min Kyu Oh, Seoul (KR); Su Young Lee, Seoul (KR); Ja Yoen Kim, Seoul (KR); Hwa Yun Choi, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 95 days.

(21) Appl. No.: 17/193,653

(22) Filed: Mar. 5, 2021

(65) Prior Publication Data

US 2021/0278110 A1 Sep. 9, 2021

(30) Foreign Application Priority Data

Mar. 6, 2020 (KR) ..... 10-2020-0028201
Aug. 18, 2020 (KR) ..... 10-2020-0103423
Oct. 27, 2020 (KR) ..... 10-2020-0140444

(51) Int. Cl.
*F25D 31/00* (2006.01)
*F25B 21/04* (2006.01)

(52) U.S. Cl.
CPC ..... *F25B 21/04* (2013.01); *F25D 31/002* (2013.01)

(58) Field of Classification Search
CPC ..... F25D 31/002; F25B 21/04; B67D 1/0869; B67D 2210/00031
See application file for complete search history.

(56) References Cited

U.S. PATENT DOCUMENTS

2004/0226960 A1* 11/2004 Aguirre ..... B67D 1/0406 222/399
2005/0274119 A1 12/2005 Lee
2010/0005811 A1 1/2010 Jaffe et al.
2015/0225222 A1 8/2015 Jaffe et al.
2018/0273072 A1* 9/2018 Saviranta ..... G07F 17/12
2018/0313583 A1 11/2018 Kawasaki
2019/0300358 A1 10/2019 Maier
2019/0335921 A1 11/2019 Jakobsen

FOREIGN PATENT DOCUMENTS

CN 101511232 A 8/2009
JP 2000-171142 A 6/2000
JP 2010-185639 A 8/2010
KR 20-0288692 Y1 9/2002
KR 10-1174393 B1 8/2012

OTHER PUBLICATIONS

Joung, Can Cooler Using Thermoelectric Element, Sep. 11, 2002, Whole Document (Year: 2002).*

* cited by examiner

*Primary Examiner* — Larry L Furdge
*Assistant Examiner* — Keith Stanley Myers
(74) *Attorney, Agent, or Firm* — Birch, Stewart, Kolasch & Birch, LLP

(57) ABSTRACT

A refrigerator includes a cabinet, a cooling guide transmitting coldness to a drink container stored in an erect state in the cabinet, a cooler located in the cabinet to cool the cooling guide, and a dispenser nozzle disposed to be at least partially exposed outside the cabinet. The cooler includes a thermoelectric element and a cooling block having a surface facing the thermoelectric element of the cooler and a surface of the cooling block facing the cooling guide, where the surfaces have different areas.

19 Claims, 21 Drawing Sheets

REFRIGERATOR FOR DRINKS

CROSS REFERENCE TO RELATED APPLICATIONS

The present application claims priority to Korean Patent Application No. 10-2020-0028201, filed on Mar. 6, 2020, Korean Patent Application No. 10-2020-0103423, filed on Aug. 18, 2020, and Korean Patent Application No. 10-2020-0140444, filed on Oct. 27, 2020, the entire contents of which are incorporated herein by reference.

BACKGROUND OF THE INVENTION

Field of the Invention

The present disclosure relates to a refrigerator for drinks and, more particularly, to a refrigerator for drinks designed to cool a drink in a bottle.

Description of the Related Art

In general, a refrigerator is a home appliance that can keep food at a low temperature in a storage space that is closed by a door. To this end, a refrigerator is configured to keep stored food in an optimal state by cooling the inside of the storage space using cold air that is generated by exchanging heat with a refrigerant circulating in a refrigeration cycle.

Recently, the function of refrigerators is increasingly varied with the tendency of a change of dietary life and an increase in quality of the products, and refrigerators having various structures and convenient equipment to enable users to conveniently use the refrigerator and efficiently use the internal space are coming into the market. In particular, as consumption and preference for alcohols such as wine and champagne increase, refrigerators suitable for keeping alcohols in accordance with the kinds of alcohols and refrigerators for keeping ripe food such as Kimchi, etc. have been developed.

Among refrigerators, the demand for a wine refrigerator that can keep drinks such as wine is recently increasing among people. A structure in which a heat sink is disposed around a drink container disposed in a storage device and the heat sink is connected to a Peltier element to reduce the temperature of the drink container has been disclosed in U.S. Patent Application Publication No. 20190300358A1 (Prior Art Document 1). A structure in which a thermoelectric element directly cools a mount in which a wine bottle is stored has been disclosed in Korean Patent No. 10-1174393 (Prior Art Document 2).

According to Prior Art Document 1, the heat sink connected to a thermoelectric element cools only a portion of a wine bottle, so the entire drink container is not uniformly cooled. Further, it takes long time to cool a drink container, so the cooling performance is low. According to Prior Art Document 2, a thermoelectric element assembly constitutes a wall of a storage space and reduces the temperature of the entire storage space in addition to the portion around a wine bottle, so the cooling performance is very low and the manufacturing cost is high.

Considering the characteristics of wine, the keeping temperature is very important to fully enjoy the flavor and aroma of wine. For example, about 5-8 degrees Celsius is good for a white wine and 13 to 18 degrees Celsius is good for a red wine, and the temperature condition may be changed depending on detailed conditions such as the type and the year of production.

However, wine refrigerators of the related art can control the temperature of the entire storage spaces, but cannot individually control temperature for the kinds of stored wines. Accordingly, there is a problem that when different kinds of wines are stored in one wine refrigerator, it is impossible to provide an optimal condition for each of the wines.

Further, the wine refrigerators of the related art have to be deep inside by at least the vertical lengths of wine bottles to keep the wine bottles and an installation space for installing a cooler has to be secured in the wine refrigerators, so there is limitation in reducing the size of the wine refrigerators.

DOCUMENTS OF RELATED ART (Patent Document 1) U.S. Patent Application Publication No. 20190300358A1

(Patent Document 2) Korean Patent No. 10-1174393

SUMMARY OF THE INVENTION

The present disclosure has been made in effort to solve the problems of the related art and an objective of the present disclosure is to enable a cooler to cool a drink container and efficiently and uniformly cool a drink container using a cooling guide surrounding the drink container.

Another objective of the present disclosure is to make it possible to set different cooling temperatures for storage compartment, respectively, in a refrigerator for drinks.

Another objective of the present disclosure is to keep drink containers erected in a refrigerator for drinks and bring a cooler in close contact with a cooling guide surrounding a drink container.

According to an aspect of the present disclosure for achieving the objectives, a cooling guide is disposed in a cabinet of the present disclosure. A cooler may cool the cooling guide. The cooler may include a thermoelectric element and a cooling block disposed between the cooling guides to exchange heat. A surface of a cooling block facing a thermoelectric element of the cooler and a surface of the cooling block facing the cooling guide may have different areas. Accordingly, the contact area between the cooling block and the cooling guide may be increased, so cooling efficiency may be increased. Alternatively, the cooling guide may be quickly cooled by bringing a large thermoelectric element in contact with the cooling block.

Several storage compartments may be provided in the cabinet. The storage compartments are separated by an insulating portion surrounding the cooling guides to be formed as independent spaces. Accordingly, the temperatures of the storage compartments may not influence the temperature of other adjacent storage compartments and different cooling temperatures may set for the storage compartments, respectively.

The drink container may be stored in an erect state in the cabinet and the cooler may be in close contact with the cooling guide. Accordingly, the width of the internal space of the cabinet may be reduced, and accordingly, the size of the refrigerator for drinks may be decreased.

The surface facing the cooling guide of both surfaces of the cooling block may be wider than the surface facing the thermoelectric element. Accordingly, the cooling block may transmit coldness generated by the thermoelectric element to a larger area of the cooling guide.

The cooling block may include a first block being in contact with the thermoelectric element and a second block being in contact with the cooling guide. The first block and the second block may have different shapes with a stepped surface therebetween.

The thickness of the second block may be larger than the thickness of the first block. Accordingly, the thickness of the insulating portion surrounding the second block may be increased, so the insulating performance between the storage compartments may be increased.

The thickness of the cooling block may be larger than the thickness of the cooling guide, and the height of the cooling block may be smaller than the height of the cooling guide. Accordingly, a space in which the insulating portion may be disposed may be sufficiently secured.

An inner frame may be disposed in the cabinet and a cooling guide may be coupled to the inner frame, whereby an inner case may be formed. At least a portion of a storage compartment, in which the drink container is stored, may be formed in the inner case. The inner frame may form the frame of the storage compartment and the cooling guide may be in charge of cooling the storage compartment.

A portion around the storage compartment may be filled with an insulating portion and the cooling guide may be disposed between the insulating portion and the storage compartment to prevent the insulating portion from being exposed to the storage compartment. The insulating portion may have insulating performance between the storage compartments and may maintain the temperature difference between the cooling guide and the heat sink at a predetermined level or higher.

The cooling guide may include a first guide connected with the cooler and a pair of second guides connected to both ends of the first guide, respectively. The first guide and the second guide may surround the drink container while forming the rear surface and sides of the storage compartment, thereby being able to cool the drink container.

The first guide may be curved and the surface of the cooling block that faces the cooling guide may be curved to be in surface contact with a surface of the cooling guide. Accordingly, the first guide may uniformly cool a curved drink container and the cooling block may be in surface contact with the cooling guide in a largest area.

Ends of the second guides that face the front surface of the cabinet may be open toward the front surface of the cabinet. An open portion between the second guides may be covered by an insulating panel. Accordingly, the insulating panel and the cooling guide may form at least a portion of the storage compartment and the storage compartment may be seen from the outside through the insulating panel.

The cooling guides may be disposed on the inner frame to extend in a height direction of the drink containers, and the cooling guides each may have an arc or circular horizontal cross-section to surround the drink containers. The cooling guide surrounding the storage compartment of the inner frame may have a same shape in the height direction. Accordingly, the cooling guide may uniformly transmit coldness to the surface of the drink container.

The cooling guide surrounding the storage compartment of the inner frame may be made of a metallic material and the cooler may include the thermoelectric element, a cooling block, and a heat sink. The cooling block may be at least partially in contact with a side of the thermoelectric element and may be in close contact with the cooling guide, thereby connecting the thermoelectric element and the cooling guide.

The coolers each may include an insulating frame surrounding the thermoelectric element, and at least a portion of the cooling block may protrude inside the insulating frame and may press the thermoelectric element toward a surface of the heat sink.

A heat dissipation fan may be disposed between the heat sink and the cabinet and may discharge air flowing inside from the outside toward the heat sink. Accordingly, heat of the heat sink may be smoothly dissipated.

An insulating panel may be disposed on a front surface of the inner frame opposite to the coolers with the storage compartments therebetween, and the insulating panel may surround the storage compartment in cooperation with the inner frame.

An air intake port for sending external air to the coolers and an air discharge port for discharging air to the outside from the coolers may be formed through a rear surface of the cabinet, and a spacer protruding outward from the cabinet may be disposed on the rear surface of the cabinet.

The spacer may be disposed at a position crossing a portion between the air intake port and the air discharge port, whereby it may be possible to prevent air in the air discharge port from flowing into the air intake port.

The refrigerator for drinks according to the present disclosure has the following effects.

In the present disclosure, the cooling guide surrounding a drink container may be cooled by the cooler, and the surface facing the thermoelectric element and the surface facing the cooling guide of both surfaces of the cooling block may have different areas. Accordingly, the contact area between the cooling block and the cooling guide may be increased, so cooling efficiency may be increased. Alternatively, the cooling guide may be quickly cooled by bringing a large thermoelectric element in contact with the cooling block.

In the present disclosure, the refrigerator for drinks may have several storage compartments, the portions between the storage compartments may be filled with an insulating portion, and a cooler may be provided for each of the storage compartments. Accordingly, since it may be possible to set different temperatures for the storage compartments, it may be possible to dependently control the temperature of drinks in accordance with the features of the drinks or user's taste, so convenience of a user may be improved.

In the present disclosure, a drink container may be kept in an erect state and at least a portion of the cooler may be in contact with the rear of the cooling guide surrounding the drink container. Accordingly, the front-rear length of the refrigerator for drinks may be decreased and an installation area for the refrigerator for drinks may be reduced. The refrigerator for drinks having a reduced installation area may be installed at various places and installation may be convenient.

In particular, in the present disclosure, the cooler may not cool the entire space inside the refrigerator and may cool the cooling guide itself surrounding a drink container or an internal space (storage compartment), so the drink container may be uniformly and efficiently cooled and the cooling efficiency of the refrigerator may be improved.

In particular, in the present disclosure, the cooling guide may surround the sides and the rear surface of a drink container and may surround most parts in the height direction of the drink container. Accordingly, the cooler may cool the entire drink container without intensively cooling only a portion of a drink container, so a drink may be more uniformly cooled.

The cooling guide of the present disclosure itself may be a portion of the inner walls defining the storage compartment and an insulating portion may be provided behind the cooling guide. Accordingly, the cooling guide may function as a partition wall separating storage compartments when an insulating material is foamed, so the insulating portion may be easily manufactured. Further, since the portion behind the cooling guide may be filled with the insulating portion, the insulating performance of the refrigerator may be further increased.

The refrigerator for drinks of the present disclosure may have a dispenser nozzle for dispensing a drink from a drink container, so it may be possible to pour a drink even without a door. Accordingly, a loss of heat that is generated when the door is open may be reduced and the energy efficiency of the refrigerator for drinks may be increased.

In the present disclosure, the insulating panel having a seeing-through portion may be installed on the front surface of the refrigerator for drinks, so the storage compartment may be exposed to the outside, and the cooling guide may form most parts of the inner walls of the storage compartment exposed to the outside. Accordingly, the inside of the storage compartment that may be seen from the outside may be made of one material as a continuous flat surface or curved surface and uniform external appearance may be provided to consumers.

In the present disclosure, the cooling guide may not be in direct contact with the insulating panel and the end of the cooling guide may be spaced apart from the insulating panel. Accordingly, it may be possible to dew condensation on the insulating panel due to a drop of the temperature of the insulating panel by the coldness of the cooling guide.

In the present disclosure, the cooling block of the cooler may be thicker than the cooling guide and may be smaller in height than the cooling guide. Accordingly, an insulating portion having sufficient thickness and height may be secured around the cooling block, so the insulating performance of the refrigerator for drinks may be increased.

Since a cooling fan may be disposed in the refrigerator for drinks of the present disclosure, external air may be suctioned and then discharged, and the air intake port and the air discharge port may be formed through the rear surface of the cabinet. Accordingly, it may be possible to prevent the possibility of a user feeling unpleasant due to air that is discharged forward, that is, toward the user.

A spacer may be disposed on the rear surface of the cabinet, so the spacer may naturally define an air flow space between the refrigerator for drinks and the wall of an installation place. Accordingly, air may more smoothly flow.

The spacer may be disposed on the rear surface of the cabinet across the portion between the air intake port and the air discharge port in the present disclosure, so the air discharged from the air discharge port may be prevented from directly flowing into the air intake port and the thermal efficiency may be increased.

The spacer disposed on the rear surface of the cabinet in the present disclosure may be held by a user, so the spacer may function as a kind of handle. Accordingly, even if there is no specific handle on the refrigerator for drinks, a user may easily move the refrigerator for drinks.

DETAILED DESCRIPTION OF THE INVENTION

Figure 1:
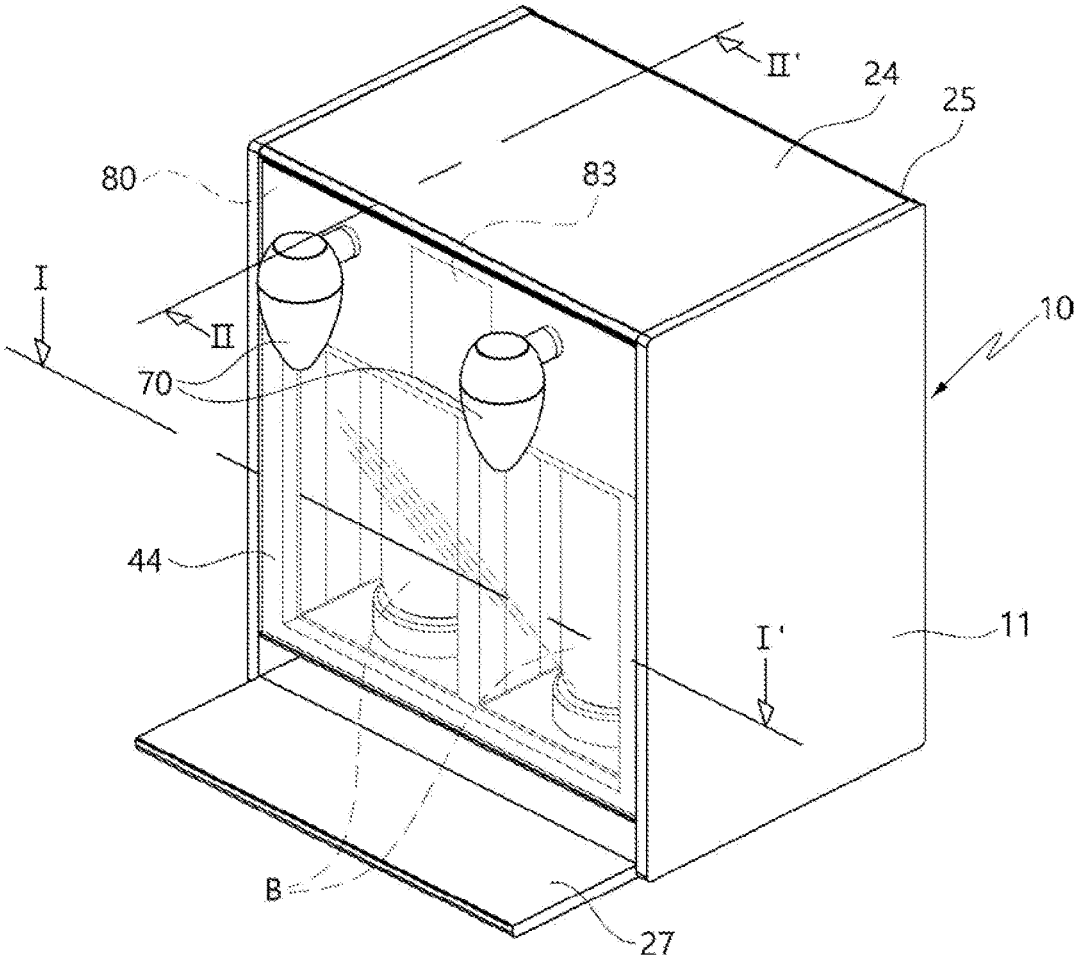
FIG. 1 is a perspective view showing the configuration of an embodiment of a refrigerator for drinks according to the present disclosure.

Hereinafter, some embodiments of the present invention are described in detail with exemplary drawings. It should be noted that when components are given reference numerals in the drawings, the same components are given the same reference numerals even if they are shown in different drawings. In the following description of embodiments of the present disclosure, when detailed description of well-known configurations or functions is determined as interfering with understanding of the embodiments of the present disclosure, they are not described in detail.

Terms "first", "second", "A", "B", "(a)", and "(b)" can be used in the following description of the components of embodiments of the present disclosure. These terms are provided only for discriminating components from other components and, the essence, sequence, or order of the components are not limited by the terms. When a component is described as being "connected", "combined", or "coupled" with another component, it should be understood that the component may be connected or coupled to another component directly or with another component interposing therebetween.

A refrigerator for drinks (hereafter, referred to as a 'refrigerator') of the present disclosure is described with reference to an embodiment. For reference, a refrigerator for keeping a drink container B that is vertically long such as a wine bottle is exemplified below, but the present disclosure may be applied to a refrigerator that may cool various drinks in bottles other than wine bottles.

Figure 2:
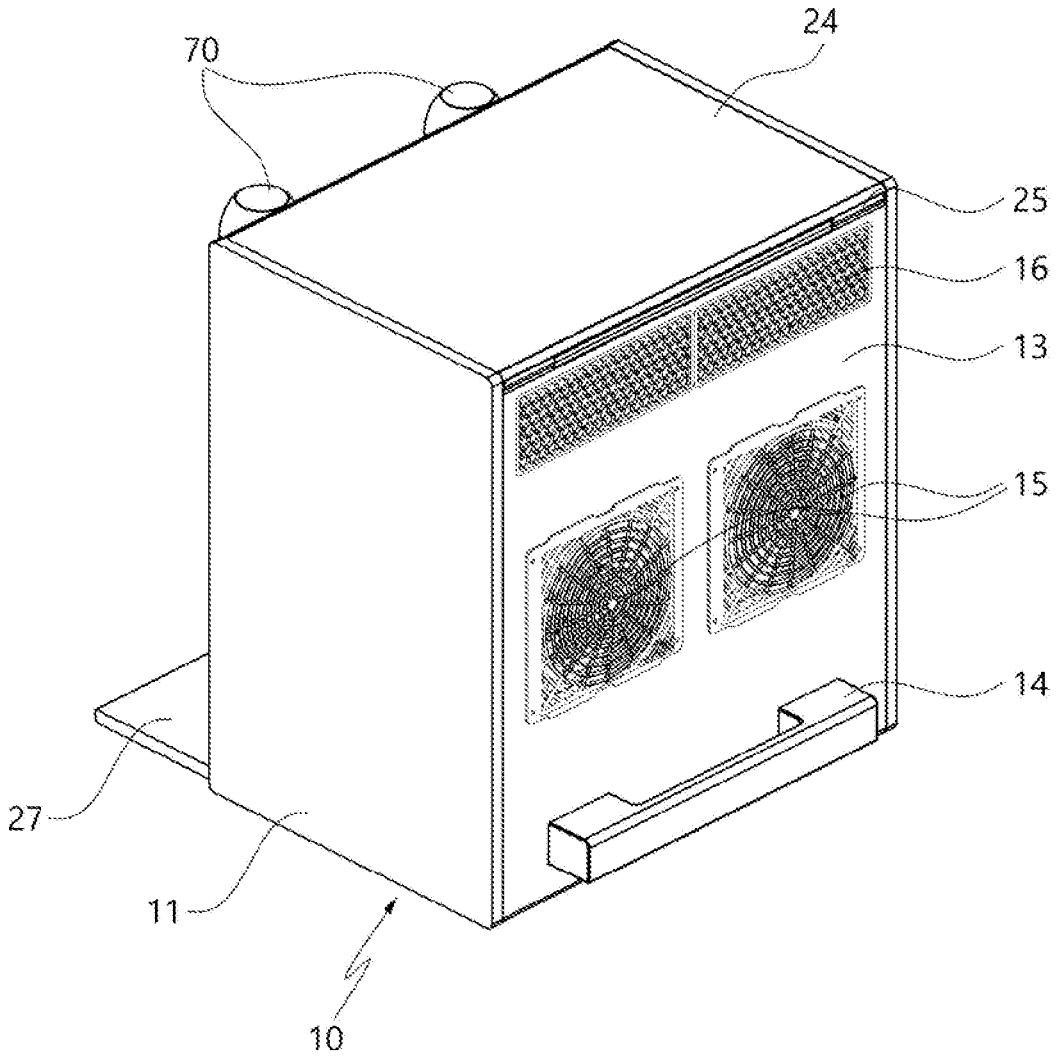
FIG. 2 is a perspective view showing the configuration of the rear surface of an embodiment of a refrigerator for drinks according to the present disclosure.

Referring to FIGS. 1 and 2, a cabinet 10, which forms the external appearance of a refrigerator, as shown in the figures, is formed such that the front-rear width is relatively short. As described above, the refrigerator according to the embodiment may have a small bottom area, so there is no need for a large installation area. Accordingly, the refrigerator may be placed on the floor or may be installed on a table.

Figure 3:
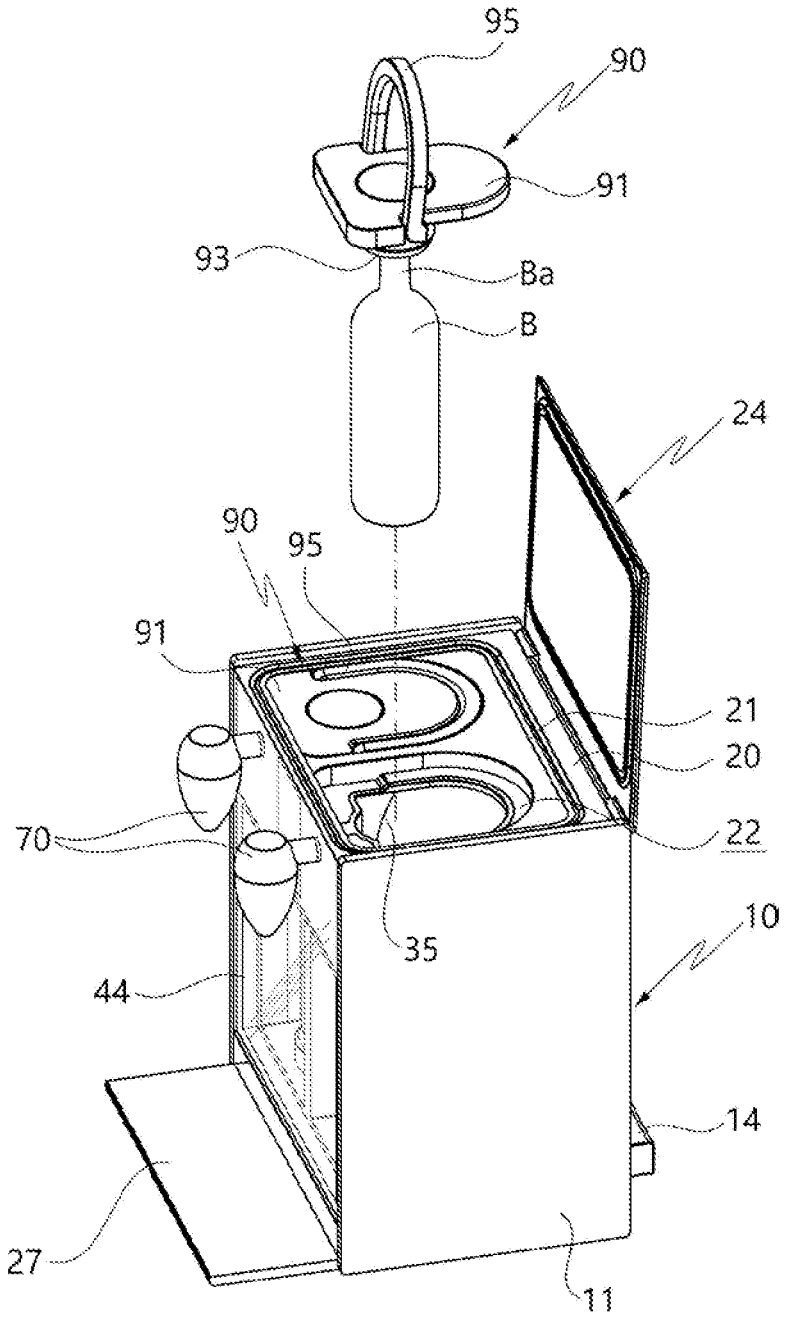
FIG. 3 is a perspective view showing the state in which a drink container has been taken out in the embodiment shown in FIG. 1.

In the embodiment, the cabinet 10 may have a substantially hexahedron shape and may have an installation space S (see FIG. 6), and an inner case 30, 40 and a cooler C to be described below may be installed in the installation space S. A storage compartment 32 may be formed inside the inner case 30, 40 and the drink container B may be stored in the storage compartment 32. For reference, the state in which the drink container B fitted in a cover assembly 90 has been taken out of the storage compartment 32 is shown in FIG. 3.

The installation space S is the entire internal space of the cabinet 10 and the storage compartment is the space defined inside the inner case 30, 40. Accordingly, it may be possible to consider that the storage compartment 32 is formed in the installation space S. The storage compartment 32, which is a space in which a drink container B is stored, is a space formed by combining several parts including a cooling guide 40 to be described below.

Figure 4:
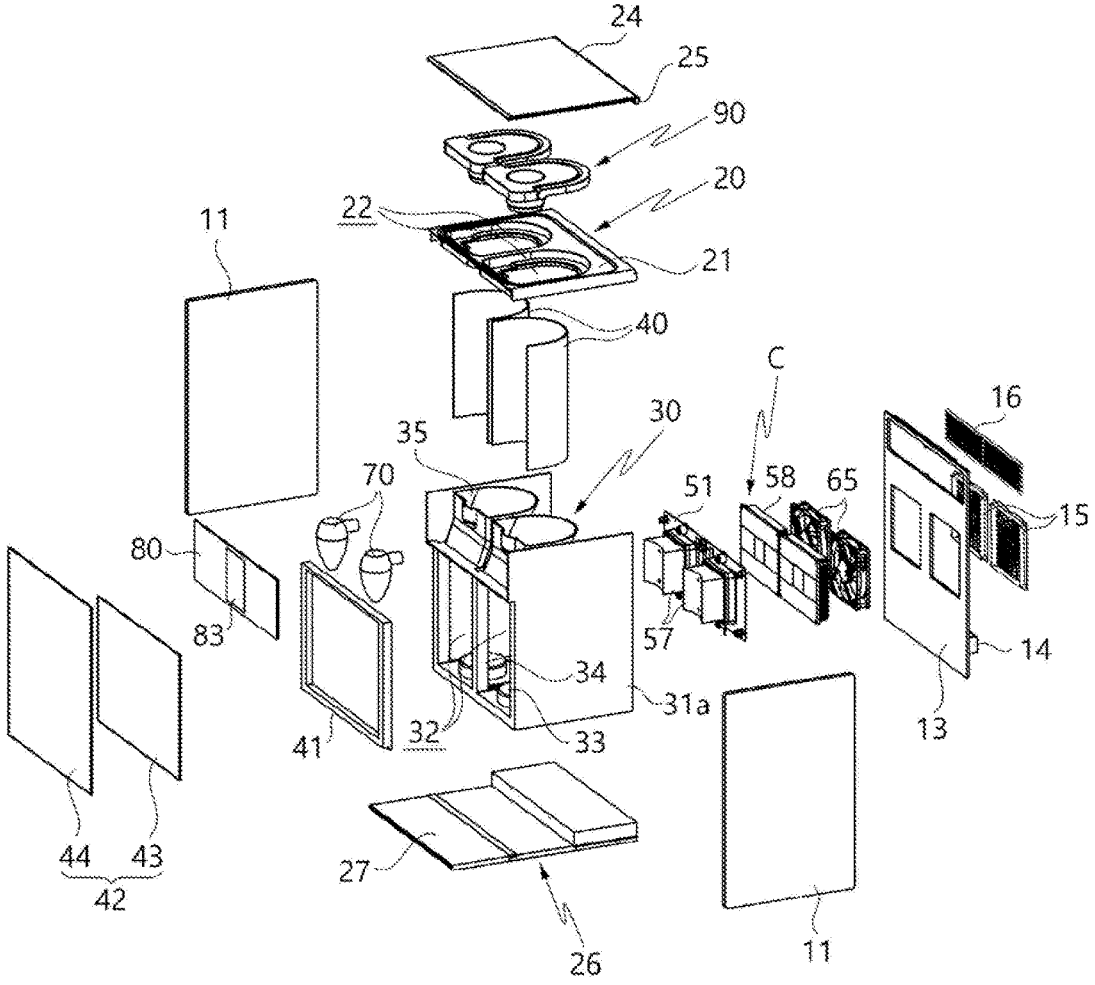
FIG. 4 is an exploded perspective view showing the parts of the embodiment shown in FIG. 1.

Referring to FIG. 4, the state in which the parts of the cabinet 10 have been disassembled is shown in FIG. 4. The cabinet 10 may include a pair of side plates 11, a rear plate 13, an upper cover 20, and a lower cover 26. The pair of side plates 11, the rear plate 13, the upper cover 20, and the lower cover 26 may be assembled, thereby forming the installation space S therein and forming the external appearance of the refrigerator. An insulating panel 42 to be described above may be disposed on the front surface of the cabinet 10, which will be described below.

As for the rear plate 13 of the cabinet 10, an air intake port and an air discharge port may be formed in the rear plate 13. The air intake port may be a part through which external air is taken inside and the air discharge port may be a part through which the air in the refrigerator is discharged outside. In this embodiment, the air intake port may be formed at an intake grille 15 coupled to the rear plate 13 and the air discharge port may be formed at a discharge grille 16 coupled to the rear plate 13. Obviously, the air intake port and the air discharge port may be directly formed at the rear plate 13 without the intake grille 15 and the discharge grille 16.

The rear plate 13 may have a spacer 14. The spacer 14 may protrude outward, that is, away from the installation space S of the refrigerator from the rear plate 13. The spacer 14, which is provided to keep a distance between the rear plate 13 and the wall of an installation place where the refrigerator is installed, may be elongated to the left and right, as shown in FIG. 2. The spacer 14 may naturally form an air flow space between the rear plate 13 and the wall of an installation place. The spacer 14 may function as a kind of handle. That is, a user may move the refrigerator with the spacer 14 by hand.

Referring to FIG. 4, the upper cover 20 may be disposed over the pair of side plates 11 and the rear plate 13 and may form the top of the installation space S. The upper cover 20 may close other space of the upper portion of the installation space S except for the inlet of the storage compartment 32. In the embodiment, a door 24 of the refrigerator may be disposed on the top of the refrigerator to selectively close the storage compartment 32 and the upper cover 20 may function as a kind of frame on which the door 24 is installed.

An open hole 22 may be formed through the center of the upper cover 20. The open hole 22 may be connected to the inlet of the storage compartment 32 to be described below and may serve to expose the storage compartment 32 to the outside when the door 24 is opened. In FIG. 3, the drink container B has been taken out through the open hole 22. A seal member 21 may be disposed around the open hole 22, and may serve to seal the portion between the top of the upper cover 20 and the door 24 when the door 24 is closed.

The door 24 may be disposed on the upper cover 20. The door 24, which is provided to selectively open the open hole 22, may be rotatably coupled to the upper cover 20 through a hinge 25 in the embodiment. The door 24 is closed in FIGS. 1 and 2 and is open in FIG. 3. Alternatively, the door 24 may be coupled to the upper cover 20 in a sliding type or the open hole 22 may be closed only by a cover assembly 90 to be described below without the door 24.

Though not shown in the figures, the door 24 may be formed by stacking several parts. Some of the parts of the door 24 may be made of an insulating material to prevent coldness in the storage compartment 32 from being taken outside through the door 24, and the door 24 may be made of a transparent or translucent material, whereby the storage compartment 32 may be seen from above.

The lower cover 26 may be disposed at the bottom of the cabinet 10 that is the opposite side to the upper cover 20. The lower cover 26 may form the bottom of the cabinet 10 and may have a flat plate structure. The lower cover 26 may provide a surface on which the refrigerator is installed, and the bottom of the lower cover 26 may be a plane.

The lower cover 26 may have a support plate 27. The support plate 27 may protrude forward from the lower cover 26 and may be considered as a part of the lower cover 26. The support plate 27 may be disposed at a position facing a dispenser nozzle 70 to be described below. Accordingly, when a drink is discharged through the dispenser nozzle 70 with a cup on the support plate 27, the cup may be filled with the drink.

An inner case 30, 40 may be disposed in the cabinet 10. The inner case 30, 40 may be disposed in the installation space S of the cabinet 10 to be surrounded by the cabinet 10. The storage compartment 32 may be formed in the inner case 30, 40 and the drink container B may be stored in the storage compartment 32. The inner case 30, 40 has several storage compartments 32 and the detailed structure thereof will be described below.

Figure 7:
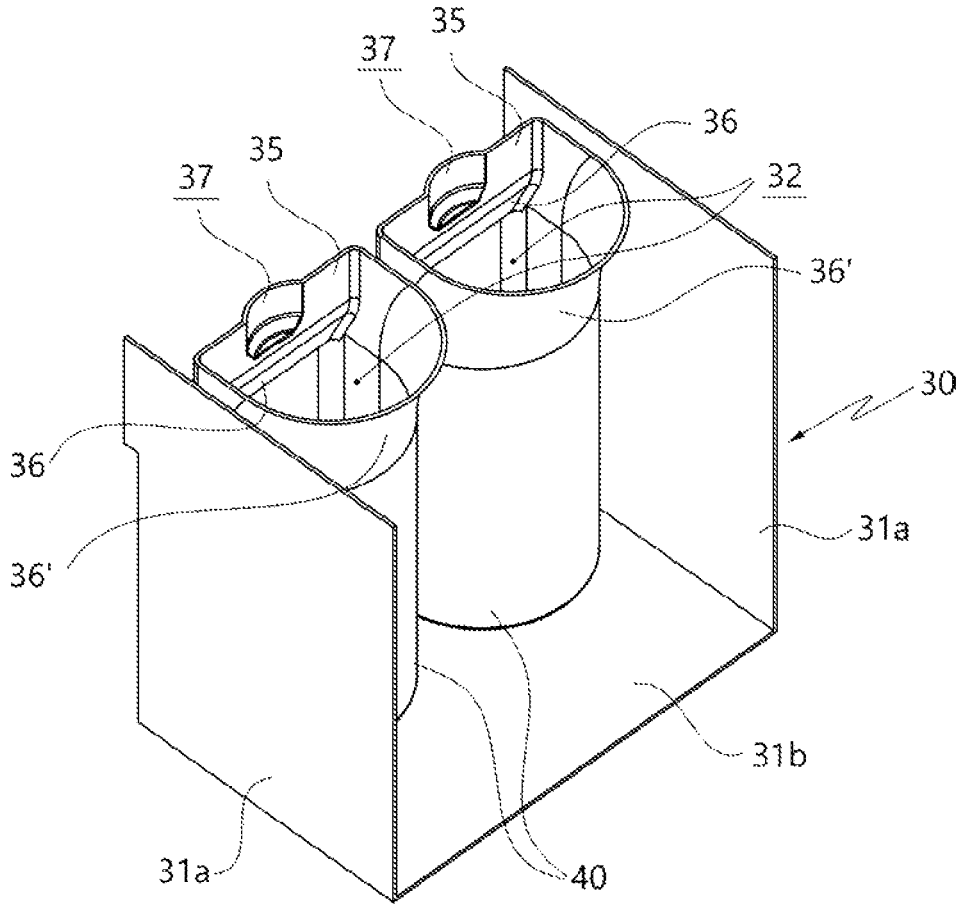
FIG. 7 is a perspective view showing the configuration of an inner case of the embodiment shown in FIG. 4.

The structure of the inner case 30, 40 is shown in detail in FIGS. 4 and 7. The inner case 30, 40 may have a three-dimensional structure surrounding the storage compartments 32 with respect the storage compartment 32 at the center. The inner case 30, 40 may have substantially a hexahedron shape in the embodiment, but is not limited thereto. The inner case 30, 40 may be entirely or at least partially made of a nonmetallic material. In the embodiment, the other portion of the inner case 30, 40 excluding a cooling guide 40 combined with the inner case 30, 40 may be made of a nonmetallic material such as synthetic resin.

In more detail, the inner case 30, 40 may include an inner frame 30 and a cooling guide 40. In the embodiment, the inner frame 30 may be made of a nonmetallic material and the cooling guide 40 made of a metallic material may be coupled to the inner frame 30, whereby the inner case 30, 40 may be configured. Accordingly, the inner frame 30 may be formed in a relatively complicated structure in comparison to the cooling guide 40 through injection molding.

Figure 8:
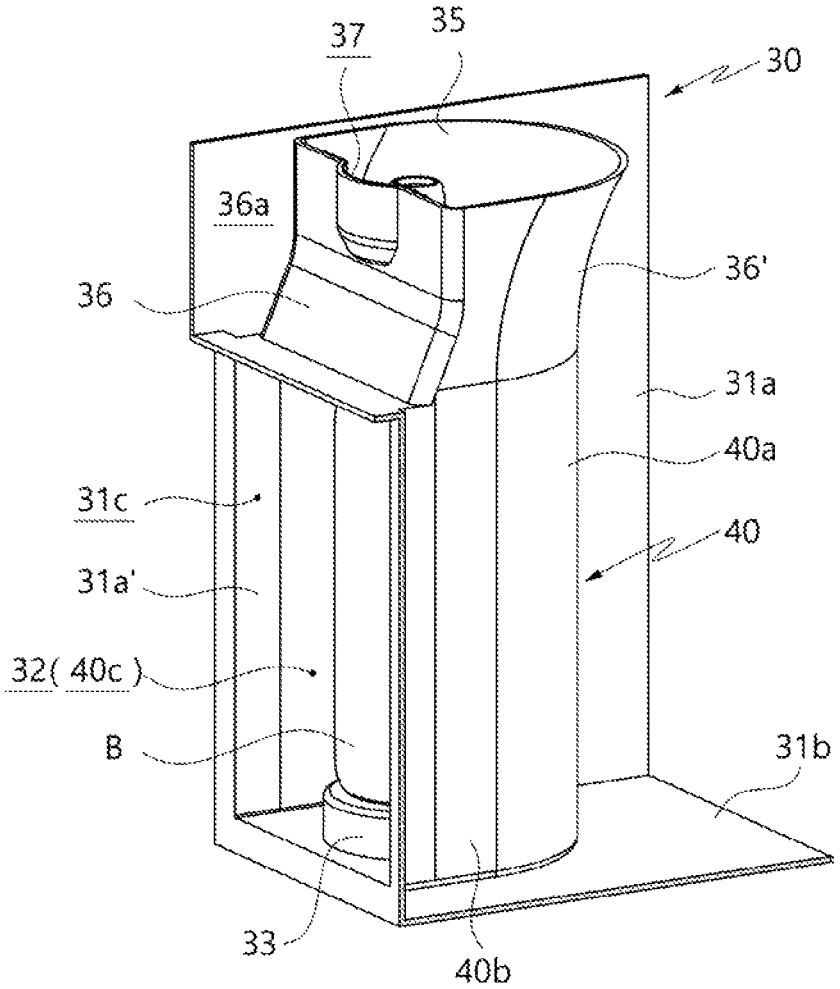
FIG. 8 is a perspective view showing the configuration of the inner case of an embodiment shown in FIG. 4 from an angle different from that in FIG. 7.

Referring to FIGS. 7 and 8, the frame of the inner frame 30 may be formed by a pair of sides 31*a* and a bottom 31*b* connecting the sides 31*a* and forming the floor. A partition wall 34 (see FIGS. 4 and 5) may be disposed between the pair of sides 31*a* and may divide the space between the pair of sides 31*a* into two sections.

A spacing portion 31*a*' is connected to each of the pair of sides 31*a*. The spacing portion 31*a*, which is a portion further protruding toward the front surface of the cabinet 10 from the side 31*a*, is a portion with which the insulating panel 42 to be described below is in close contact. That is, the spacing portion 31*a*' may be considered as being positioned between the cooling guide 40 and the insulating panel 42 to prevent contact between the insulating panel 42 and the cooling guide 40.

As shown in FIG. 8, the front of the side 31*a* may be open, thereby forming an opening 31*c*. The opening 31*c* may be a kind of window being open forward from the inner frame 30 and may be closed by the insulating panel 42. The storage compartment 32 may be positioned inside the opening 31*c* and a cooling space 40*c* surrounded by a cooling guide 40 to be described below may be a portion of the storage compartment 32. For reference, FIG. 8 is a cross-sectional view showing only a portion of the inner case 30, 40 such that the structure of the cooling guide 40 is shown well.

Insertion guides 35 may be disposed inside the inner frame 30 surrounded by the pair of sides 31*a* and the bottom 31*b*. The insertion guide 35 may be connected to the side 31*a* or the bottom 31*b*, but in the embodiment, the insertion guide 35 may be connected to the side 31*a*.

The insertion guide 35 may be spaced upward apart from the bottom 31*b*. The insertion guide 35 may surround at least a portion of the drink container B and it may be considered that a portion of the storage compartment 32 is formed inside the insertion guide 35. In the embodiment, the insertion guide 35 may surround the inlet Ba of the drink container B.

Figure 6:
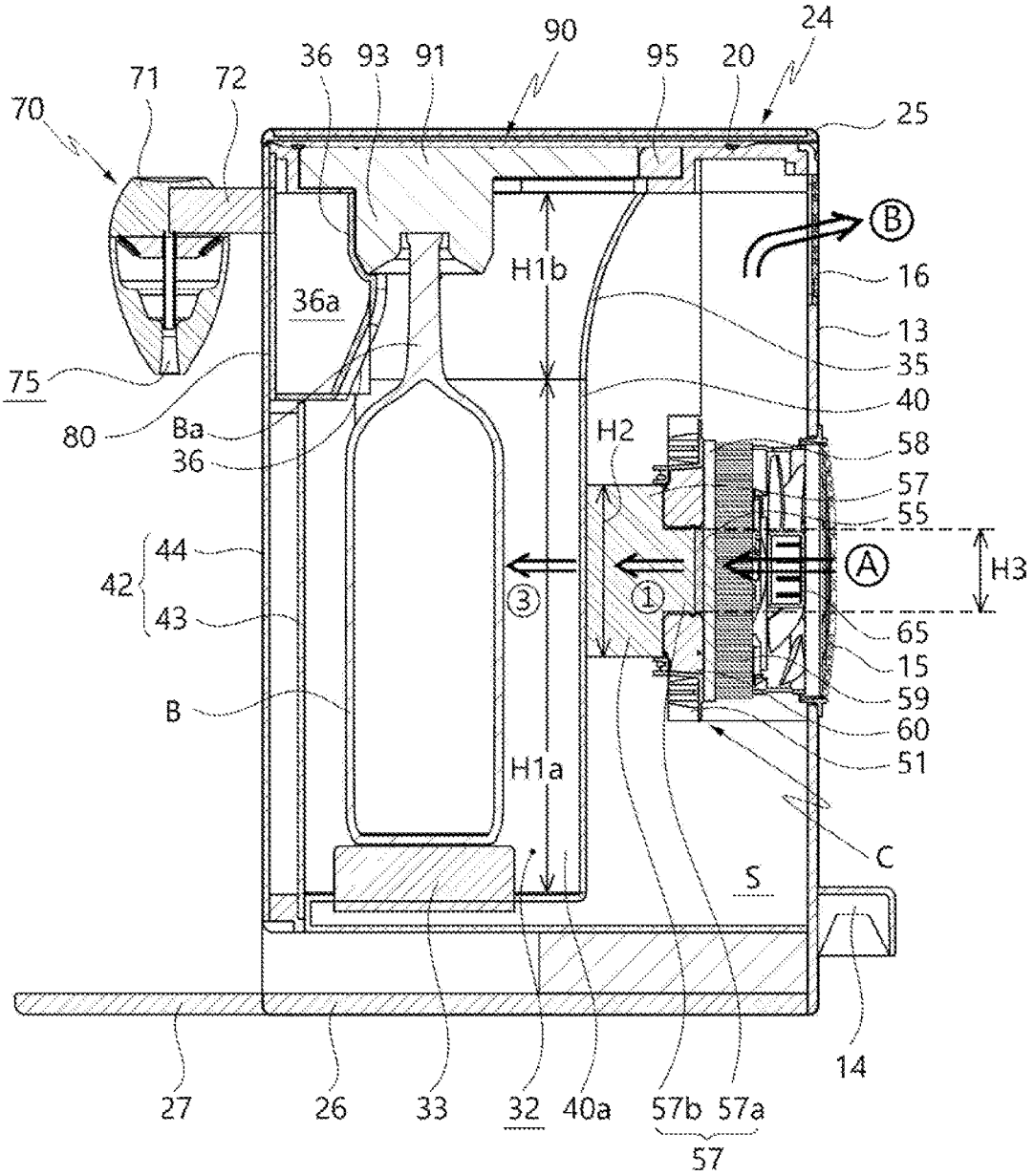
FIG. 6 is a cross-sectional view taken along line II-II' of FIG. 1.

As shown in FIG. 6, a bed 33 may be disposed on the bottom 31*b*. The bed 33 may protrude toward the storage compartment 32 from the bottom 31*b* in a substantially cylindrical shape. The bed 33 may be a part that supports the bottom of the drink container B. Though not shown in the figures, the bed 33 may have a spring, so the bed 33 may be elastically supported by the spring.

In the embodiment, the insertion guides 35 may be positioned between the pair of sides 31*a* close to the top of the inner frame 30. The insertion guide 35 may extend in the height direction of the drink container B and may be connected to the cooling guide 40 at the lower end. The cooling guide 40 may be connected to the insertion guide 35 to have a continuous surface and may extend to the bottom 31*b*.

The insertion guide 35 may be several pieces. Two insertion guides 35 may be disposed between the pair of sides 31*a* in the embodiment. A partition wall 34 may be disposed between the pair of insertion guides 35. The partition wall 34 may be a part vertically extending and separating two storage compartments 32. The partition wall 34 may meet the cooling guide 40 to be described below at an end, thereby serving to support the cooling guide 40. That is, the insertion guide 35 may be provided inside the inner frame 30 as many as the number of the cooling guide 40.

Referring to FIG. 8, the front of the insertion guide 35, which faces the front of the cabinet 10, may form the front surface of the insertion guide 35. The front of the insertion guide 35 and the inner surface of the cabinet 10 may be spaced apart from each other, whereby a mount space 36*a* may be formed. A display 83 (see FIG. 4), etc. may be installed in the mount space 36*a*.

The insertion guide 35 may have a shape recessed rearward by the front 36 and it may be considered that the mount space 36*a* is formed by the recessed portion. A portion of the front 36 may be inclined such that the width of the storage compartment 32 decreases upward, that is, toward the upper cover 20. In the embodiment, the lower portion of the front 36 may be an inclined surface inclined rearward and the upper portion thereof may vertically extend.

An extension 36' increasing the inlet of the storage compartment 32 may be formed opposite to the front 36 of the insertion guide 35. The extension 36' may widen the inlet of the storage compartment 32 in the left, right, and rearward directions as the inlet goes up. That is, the extension 36' may be inclined such that the inlet of the storage compartment 32 expands toward the left and right sides 31*a* of the inner frame 30 and away from the insulating panel 42 at the rear.

The extension 36' may guide the drink container B such that the drink container B can be inserted into the center of the storage compartment 32 when the drink container B is inserted into the storage compartment 32. Even if a user does not insert the drink container B right at the center of the storage compartment 32, the drink container B may be moved over the extension 36' and naturally guided to the center of the storage compartment 32.

As described above, since the expansion 36' may extend to widen the inlet of the storage compartment 32, but the front 36 is recessed toward the rear of the cabinet 10, the front 36 may somewhat reduce the width of the upper portion of the storage compartment 32. Accordingly, the volume of the storage compartment 32 may also decrease, so the storage compartment 32 may be more effectively cooled. The outer side of the expansion 36', that is, the installation space S disposed opposite to the storage compartment 32 may be filled with an insulating portion G (see FIG. 5). This is clearly shown in FIG. 6.

The insertion guide 35 may have a seat groove 37. The seat groove 37 may be formed at the inlet of the insertion guide 35 and may be recessed in a direction in which the inlet of the insertion guide 35 is expanded. The seat groove 37 may be formed substantially in an arc shape and a portion of the cover assembly 90 to be described below may be fitted in the seat groove 37. The shape of the seat groove 37 may be changed to fit to the shape of the cover assembly 90.

The cooling guide 40 may be coupled to the inner frame 30. The cooling guide 40 may be coupled to the lower portion of the insertion guide 35, thereby being a part of the inner case 30, 40. Accordingly, it may be considered that the cooling guide 40 may be a portion of the inner case 30, 40 and may define a portion of the storage compartment 32. More specifically, the cooling guide 40 may be a portion of the inner walls of the storage compartment 32. The inner walls 32 may be the inner surfaces of the storage compartment 32 which surround the storage compartment 32.

When the cooling guide 40 is coupled to the insertion guide 35, a portion of the storage compartment 32 may be formed inside. Although the cooling guide 40 is separated from the inner frame 30 in FIG. 4, the cooling guide 40 has been coupled to the lower portion of the insertion guide 35 of the inner frame 30 in FIG. 7.

More specifically, the inner case 30, 40 may define the storage compartment 32 together with the insulating panel 42 and the cooling guide 40 may constitute a portion of the inner case 30, 40. Accordingly, the cooling guide 40 may also be a part defining a portion of the storage compartment 32 and may constitute a portion of the inner walls of the storage compartment 32.

The cooling guide 40 may surround at least a portion of a drink container B stored in an erect state in the storage compartment 32 and may separate the storage compartment 32 and the insulating portion G. The 'separating' may mean that the cooling guide 40 may be disposed between the storage compartment 32 and the insulating portion G to prevent direct connection therebetween. Accordingly, when the cooling guide 40 separates the storage compartment 32 and the insulating portion G, the insulating portion G may not be exposed to the storage compartment 32.

When the cooling guide 40 is coupled to the insertion guide 35, the cooling guide 40 and the insertion guide 35 may be continuously connected. Accordingly, the storage compartment 32 may be formed as one space by the insertion guide 35 and the cooling guide 40. In the embodiment, if the insertion guide 35 surrounds the inlet Ba, that is, the upper portion of the drink container B, it may be considered that the cooling guide 40 surrounds the main body of the drink container B.

In more detail, the insertion guide 35 and the cooling guide 40 may form a portion of the storage compartment 32. The other portion of the storage compartment 32 may be closed by the bottom 31*b*, and the insulating panel 42 and the cover assembly 90 to be described below. As a result, the storage compartment 32 may be considered as a closed space defined by the inner case 30, 40 including the cooling guide 40, and the cabinet 10.

The cooling guide 40 may be configured to surround at least a portion of the storage compartment 32 and may serve to reduce the temperature of the storage compartment 32. The cooling guide 40 may be controlled in temperature by being directly connected to the cooler C to be described below. For example, when the temperature of the cooling guide 40 is decreased by operation of the cooler C, the temperature of the storage compartment 32 that is the space inside the cooling guide 40 also decreases.

To this end, the cooling guide 40 may be made of a material with high thermal conductivity. In the embodiment, the cooling guide 40 may be made of aluminum. Alternatively, the cooling guide may be made of various materials such as an aluminum alloy, copper, or a copper alloy.

The cooling guide 40 may have a substantially arc-shaped horizontal cross-section. The cooling guide 40 may be open forward, so a portion of the storage compartment 32 may also be open forward, but the insulating panel 42 to be described below may be coupled to the front of the storage compartment 32, so the storage compartment 32 may be closed. Alternatively, the cooling guide 40 may have a circular horizontal cross-section or may have a polygonal horizontal cross-section, rather than an arc shape, to fully surround the storage compartment 32.

Figure 9:
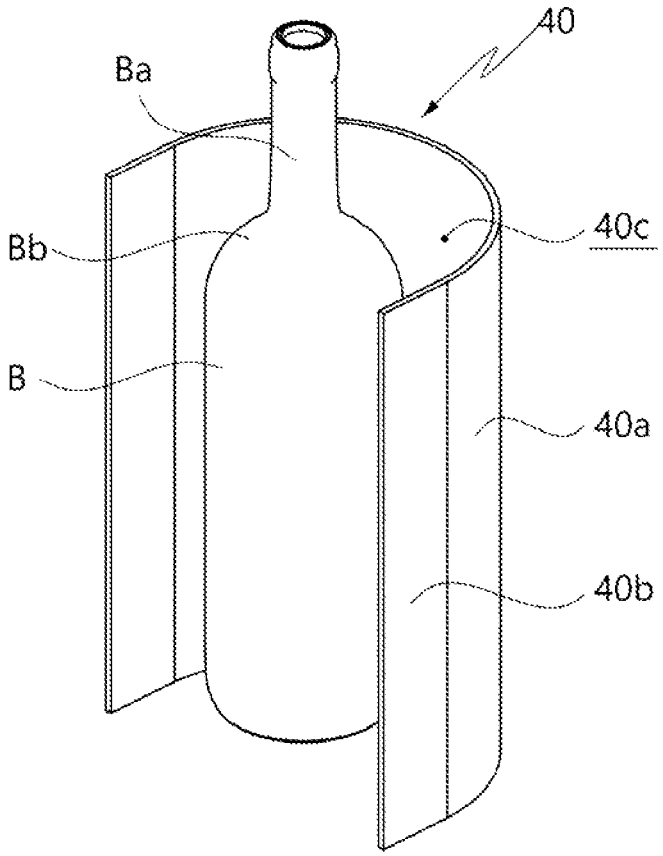
FIG. 9 is a perspective view showing the configuration of a cooling guide of the embodiment shown in FIG. 4.

In more detail, as shown in FIG. 9, the cooling guide 40 may include a first guide 40*a* and a second guide 40*b*. The cooler 50 may be connected to the first guide 40*a* and the first guide 40*a* may form the rear of a cooling space 40*c* defined by the cooling guide 40. The cooling space 40*c*, which is a space surrounded by the cooling guide 40, may be considered as a portion of the storage compartment 32. The cooling space 40*c* may not configure a space closed only by the cooling guide 40, but may be a portion of the storage compartment 32, so it may be a closed space when the storage compartment 32 is closed.

The second guide 40*b* may be connected to the first guide 40*a* and may extend toward the front surface of the cabinet 10, that is, toward the insulating panel 42. The second guide 40*b* may surround both sides of the cooling space 40*c*. Obviously, the first guide 40*a* and the second guide 40*b* may be integrally formed in the embodiment, but may be discriminated in this way in terms of the shape and position.

In the embodiment, the first guide 40*a* of the cooling guide 40 may have a polygonal horizontal cross-section rather than an arc shape and may vertically extend in a uniform shape. That is, the cooling guide 40 surrounding the cooling space 40*c* may have a vertically uniform horizontal cross-sectional shape. Accordingly, temperature may be uniformly distributed throughout the entire cooling guide 40, thereby being able to prevent great temperature changes throughout the cooling guide 40.

The surface of the second guide 40*b* may be flat rather than curved. In the embodiment, the second guide 40*b* is a pair of flat structures and the second guides 40*b* may extend in parallel with each other at both ends of the first guides 40*a*, whereby the cooling space 40*c* may be formed.

Referring to FIG. 9, the second guide 40*b* may be provided in a pair and may extend forward in parallel from the first guide 40*a*. As the pair of second guides 40*b* extends forward in parallel with the side plate 11, the range exposing a drink container in the cooling space 40*c* to the front may be increased. More specifically, since the pair of second guides 40*b* may be respectively connected to both ends of the insulating panel 42, the visual field of a user may not be interfered with the cooling guide 40 when the user sees the inside of the refrigerator through the insulating panel 42.

The cooling guide 40 may have a height that can surround at least ½ or more of the drink container B in order to effectively cool the drink container B. Referring to FIG. 6, it can be seen that, in the embodiment, the height H1*a* of the cooling guide 40 is larger than the height of the other portion excepting the inlet Ba of the drink container B, that is, the height of the main body, so the cooling guide 40 surrounds most of the portion in which a drink is contained of the drink container B. The sum of the height H1*a* of the cooling guide 40 and the height H1*b* of the insertion guide 35 may be larger than the height of the entire drink container B.

Figure 10:
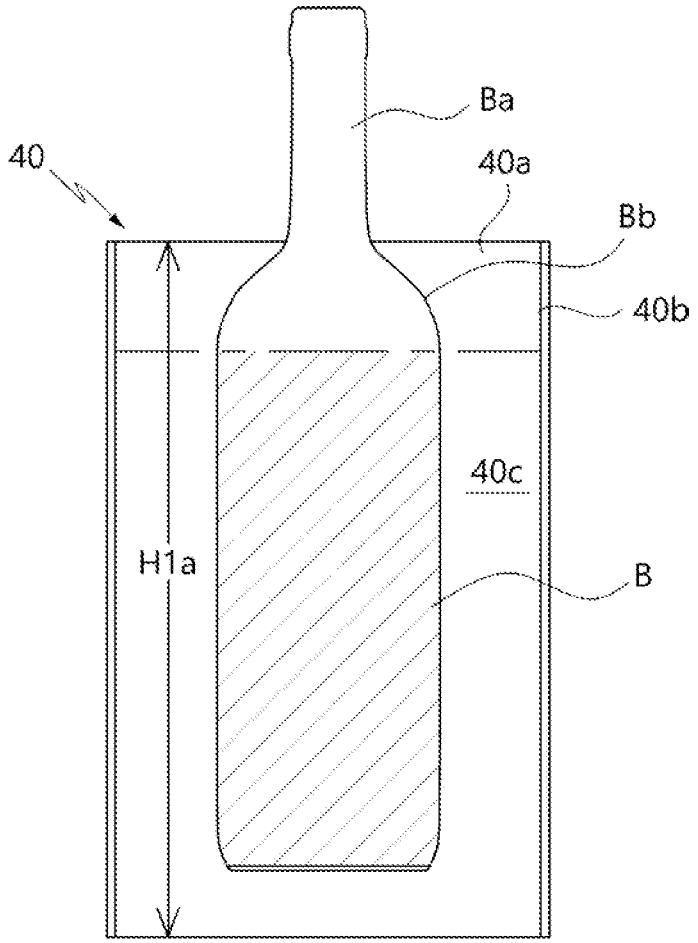
FIG. 10 is a front view showing the structure in which a cooling guide of the embodiment shown in FIG. 4 surrounds a drink container.

Referring to FIG. 10, the height H1 of the cooling guide may be larger than that of the body of the drink container B. The body of the drink container may be the portion under the inlet Ba and the shoulder Bb under the neck of the drink container B and is hatched in FIG. 10. The height H1*a* of the cooling guide 40 may be larger than that of the body of the drink container B in the embodiment, but the height H1*a* of the cooling guide 40 may be the same as that of the body of the drink container B.

The lower end of the cooling guide 40 may extend downward further than the lower end of the drink container B or may have the same height as the lower end of the drink container B. Accordingly, the cooling guide 40 may transmit coldness to the entire height section of the body of the drink container B.

Figure 11:
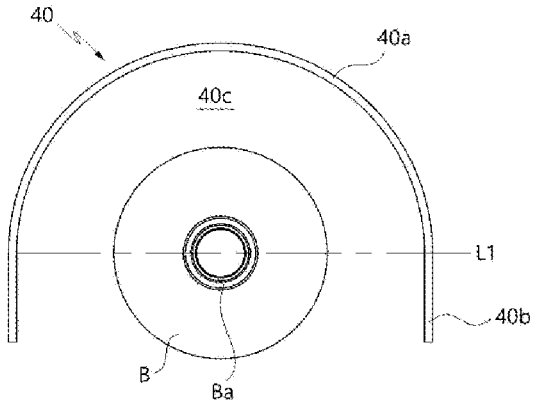
FIG. 11 is a plan view showing the configuration of the cooling guide of the embodiment shown in FIG. 4.

Referring to FIG. 11, the first guide 40*a* of the cooling guide may be disposed behind the drink container B and the second guide 40*by* may be disposed ahead of the drink container B and surround the drink container B. The cooling space 40*c* that is the portion surrounding the drink container B, as described above, may be a portion of the storage compartment 32. The drink container B is open forward and this portion may be covered by the insulating panel 42 described above.

The second guide 40*b* of the cooling guide 40 may surround even the portion ahead of the center of the drink container B. L1 is a virtual line crossing the center of the drink container B in FIG. 11, in which the second guide 40*b* may protrude further than the center line forward, that is, toward the front of the cabinet 10. Accordingly, the cooling space 40*c* may be sufficiently widened such that coldness can be sufficiently transmitted to the left and right of the drink container B.

Figure 12:
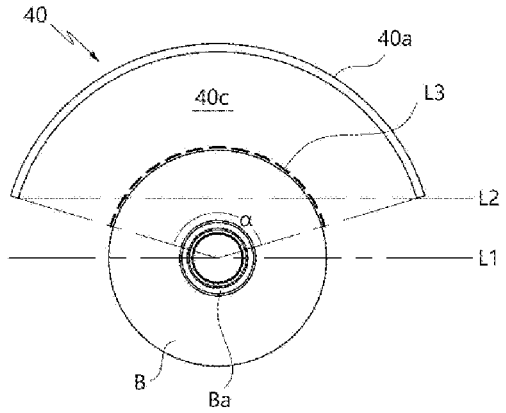
FIG. 12 is an enlarged plan view showing another embodiment of the cooler of a refrigerator for drinks according to the present disclosure.

Referring to FIG. 12, another embodiment of the cooling guide 40 of the present disclosure is shown. In FIG. 12, the angle made by both ends of the cooling guide 40 facing the front of the cabinet 10 and the center of the cooling space 40*c*, that is, the center of the drink container B is indicated by a. The angle α made by both ends of the cooling guide 40 and the center of the drink container B may be 30 degrees to 270 degrees. Accordingly, the cooling guide 40 may uniformly transmit coldness while sufficiently surrounding the drink container B.

Figure 13:
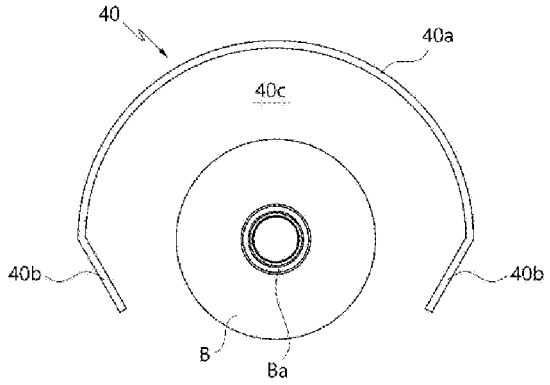
FIG. 13 is an enlarged plan view showing another embodiment of the cooler of a refrigerator for drinks according to the present disclosure.

Referring to FIG. 13, another embodiment of the cooling guide 40 of the present disclosure is shown. As shown in the figure, the second guide 40*b* of the cooling guide 40 may further extend in a direction in which the width of the cooling space 40*c* is reduced. Accordingly, the front area of the storage compartment 32 that is shown forward through the insulating panel 42 may be decreased, but the area in which the cooling space 40*c* surrounds the drink container B may be increased.

Meanwhile, referring to FIG. 5 again, it may be considered that the cooling guide 40 extends along the side plates 11 and the rear plate 13 of the cabinet 10 and surrounds a portion of the drink container B stored in the storage compartment 32. That is, the second guide 40*b* of the cooling guide 40 may extend in parallel with the side plate 11 and the first guide 40*a* may have a shape curved to face the rear plate 13.

The cooling guide 40 may extend along at least two surfaces of four surfaces constituting the sides of the cabinet 10. The sides of the cabinet 20 may be the pair of side plates 11, the rear plate 13, and the insulating panel 42. The cooling guide 40 may extend along the pair of side plates 11 and the rear plate 13 that are three surfaces of the four surfaces constituting the sides of the cabinet 10 in the embodiment. However, alternatively, the cooling guide 40 may extend along only one side plate 11 or the rear plate 13 or may extend along only the insulating plate 42 and one side plate 11.

If the cabinet 10 has a cylindrical shape rather than the structure having four sides, sides may not be discriminated. In this case, the open direction of the cooling guide 40 through the portion between the pair of second guides 40*b* may be changed, but, as described with reference to FIG. 12, when the angle α made by the ends of the pair of second guides 40*b* and the center of the drink container B is 30 degrees to 270 degrees, a sufficient coldness transmission area may be secured.

Figure 5:
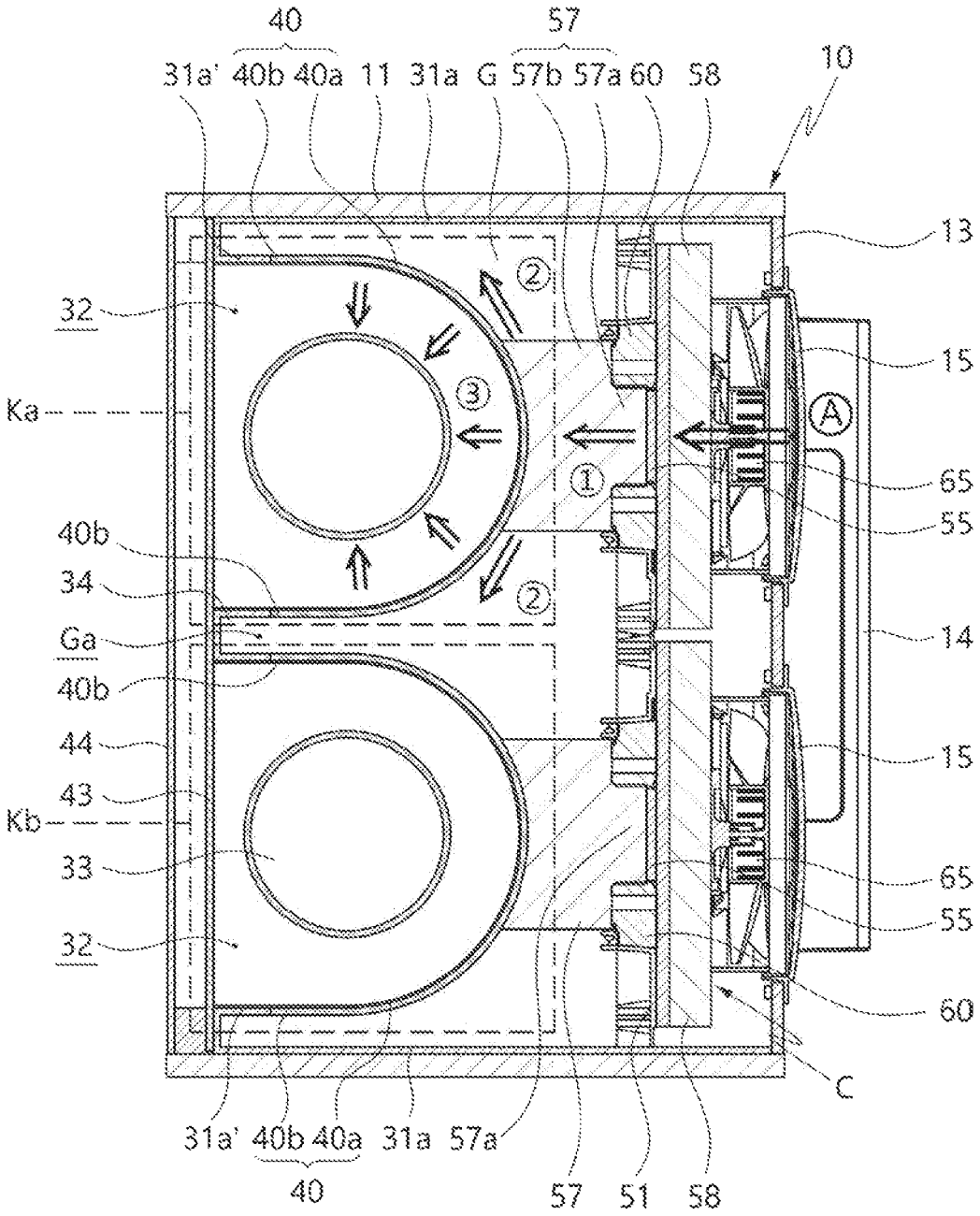
FIG. 5 is a cross-sectional view taken along line I-I' of FIG. 1.

In the embodiment, the end of the second guide 40*b* of the cooling guide 40 may be spaced apart from the insulating panel 42. Referring to FIG. 5, the end of the second guide 40*b* which faces the surface of the first panel 43 of the insulating panel 42 may be spaced apart from the first panel 43. The portion between the first panel 43 and the end of the second guide 40*b* may be filled with a portion of the inner frame 30 disposed in the installation space S, in more detail, the spacing portion 31*a*' of the side 31*a*.

Accordingly, it may be possible to prevent dew condensation on the insulating panel 42 due to the cooling guide 40 being colder than the external air. That is, since the cooling guide 40 is not in direct contact with the insulating panel 42, it may be possible to prevent due condensation on the insulating panel 42 due to a temperature drop of the insulating panel 42 by the coldness of the cooling guide 40.

Although the inner case 30, 40 may be composed of the inner frame 30 and the cooling guide 40 in the embodiment, the inner case 30, 40 may be composed of only the cooling guide 40. That is, only the cooling guide 40 may function as the inner case 30, 40 without the inner frame 30.

Meanwhile, the front surface of the inner case 30, 40 may be open, the storage compartment 32 may be open forward, and the open portions may be closed by the insulating panel 42. The insulating panel 42 may be disposed on the front surface of the inner case 30, 40 opposite to the cooler C with the storage compartments 32 therebetween and may be made of an insulating material in a flat plate structure.

The insulating panel 42 may surround the storage compartments 32 disposed together with the inner case 30, 40. More specifically, the cooling guides 40, the insulating panel 42, and the bottom 31*b* may form the storage compartments 32 and the tops of the storage compartments 32 may be selectively closed by the cover assemblies 90 and the door 24. As a result, it may be considered that the storage compartment 32 may be defined by the inner case 30, 40, the cover assembly 90, and the insulating panel 42.

The insulating panel 42 may be composed of at least one or more pieces of insulating glass. In the embodiment, the insulating panel 42 may be composed of a first panel 43 and a second panel 44, which may be insulating glass. Accordingly, a user may see the storage compartments 32 through the first and second transparent panels 43 and 44 and may observe the drink containers B in the storage compartments 32. A user may recognize the kinds of the drinks in the storage compartments 32 through the insulating panel 42. An empty space may be defined between the first panel 43 and the second panel 44 and the empty space may be vacuum.

The first panel 43 may be smaller than the second panel 44 in the embodiment. The overlapping portion of the first panel 43 and the second panel 44 may be a seeing-through portion and the seeing-through portion may be a kind of window enabling a user to see the storage compartment 32 from the outside. The height of the seeing-through portion may be the same as or larger than that of the cooling guide 40. Accordingly, the cooling guide 40 may occupy most part of the inside of the storage compartment 32 that shown through the seeing-through portion and the aesthetic appearance may be improved. Obviously, since the cooling guide 40 may have a height at least as large as that of the seeing-through portion, the cooling efficiency by the cooling guide 40 may also be increased.

The first panel 43 and the second panel 44 of the insulating panel 42 may be mounted on an installation frame 41. The installation frame 42 (see FIG. 4) may be mounted on the front surface of the side 31*a* of the inner frame 30, and more specifically, the installation frame 41 may be in close contact with the spacing portion 31*a*' extending from the side 31*a*. The first panel 43 may be disposed inside the installation frame 41 in the embodiment. The second panel 44 may be directly coupled to the front surface of the inner frame 30. Obviously, alternatively, the insulating panel 42 may be only one layer or may be composed of three or more layers.

Alternatively, the insulating panel 42 may be the front panel facing the front surface of the cabinet 10 rather than being composed of several layers of panels.

The storage compartments 32 formed in the inner case 30, 40 may be separated as several independent spaces by the cooling guides 40 coupled to the inner frame 30 and the insulating portion G surrounding the outer side of the cooling guide 40. As described above, the storage compartment 32 may be defined by the inner case 30, 40, the insulating panel 42, and the cover assembly 90, and several independent storage compartments 32 may be formed.

Referring to FIG. 5, it can be seen that there are two different separate storage compartments 32. The two storage compartments 32 may be surrounded by separate inner cases 30, 40, respectively, with a gap therebetween. Reference characters 'Ka' and 'Kb' are provided to discriminate the two independent storage compartments 32.

In more detail, a partition insulation portion Ga may exist between two adjacent cooling guides 40. The insulating portion G may exist in other portions of the installation space S, but the partition insulation portion Ga may also be formed in the portion between the two storage compartments 32. Accordingly, it may be possible to prevent heat transfer between adjacent different cooling guides 40, whereby the storage compartments 32 may be independently further effectively cooled. The insulating portion G may be a foamed insulating portion such as polyurethane resin, or an insulating portion G that is a separate part may be inserted in the installation space S that is an empty space, or it may be an empty space.

The insulating portion G may be filled between the outer side of the cooling guide 40 and the inner surface of the cabinet 10. That is, when the insulating portion G is filled, the cooling guide 40 may serve to separate a space such that filling liquid does not enter the storage compartments 32 in cooperation with the insertion guide 35.

Next, the cooler C is described hereafter. The cooler C may be disposed in the installation space S to reduce the temperature of the storage compartment 32. When the temperature of the storage compartment 32 decreases, the temperature of the drink container B in the storage compartment 32 may also decrease. In the embodiment, the cooler C may be at least partially in contact with the inner case 30, 40 surrounding the storage compartments 32, whereby cooling performance may be increased.

The cooler C may be disposed close to the storage compartment 32 to decrease the temperature of the storage compartment 32. The cooler C may be disposed at various positions except for the portion between the storage compartment 32 and the insulating panel 42. For example, the cooler C may be disposed at the left or right side of the storage compartment 32 or may be disposed behind the storage compartment 32.

As shown in FIG. 4, the cooler C may be disposed behind the storage compartment 32 opposite to the insulating panel 42. When the cooler C is disposed behind the storage compartment 32, one side of the cooler C may face the intake grille 15 and the discharge grille 16 of the rear plate 13, whereby cooling efficiency may be increased. Further, in the embodiment, since the widest installation space S may be secured behind the storage compartment 32, it may be easy to install the cooler C.

Several coolers C may be provided. More specifically, the number of the coolers C may be the same as the number of the storage compartments 32, and since two storage compartments 32 may be provided in the embodiment, two coolers C may be provided. The several coolers C may serve to separately decrease the temperature of the corresponding storage compartments 32. Accordingly, the internal temperatures of the several storage compartments 32 may be set at different levels, so the storage compartments 32 may be independently cooled. Obviously, if there are only one cooling guide 40 and one storage compartment 32, only one cooler C may be provided.

Referring to FIGS. 5 and 6, cold air generated by the cooler C may flow toward the cooling guide 40 (in the direction of the arrow ①) and may cool the entire cooling guide 40 while flowing on the surface of the cooling guide 40 (in the direction of the arrow ②). Further, the cooled cooling guide 40 may provide the cold air to the storage compartment 32 (in the direction of the arrow ③). Accordingly, the storage compartment 32 may be cooled.

As for the configuration of the cooler C, the cooler C may include a thermoelectric element 55 and the thermoelectric element 55 may keep the temperature of the storage compartment 32 low using the Peltier effect. The cooler C may have a structure connecting a low-temperature portion of the thermoelectric element 55 to the storage compartment 32 and discharging heat from a high-temperature portion to effectively cool the storage compartment 32.

Figure 14:
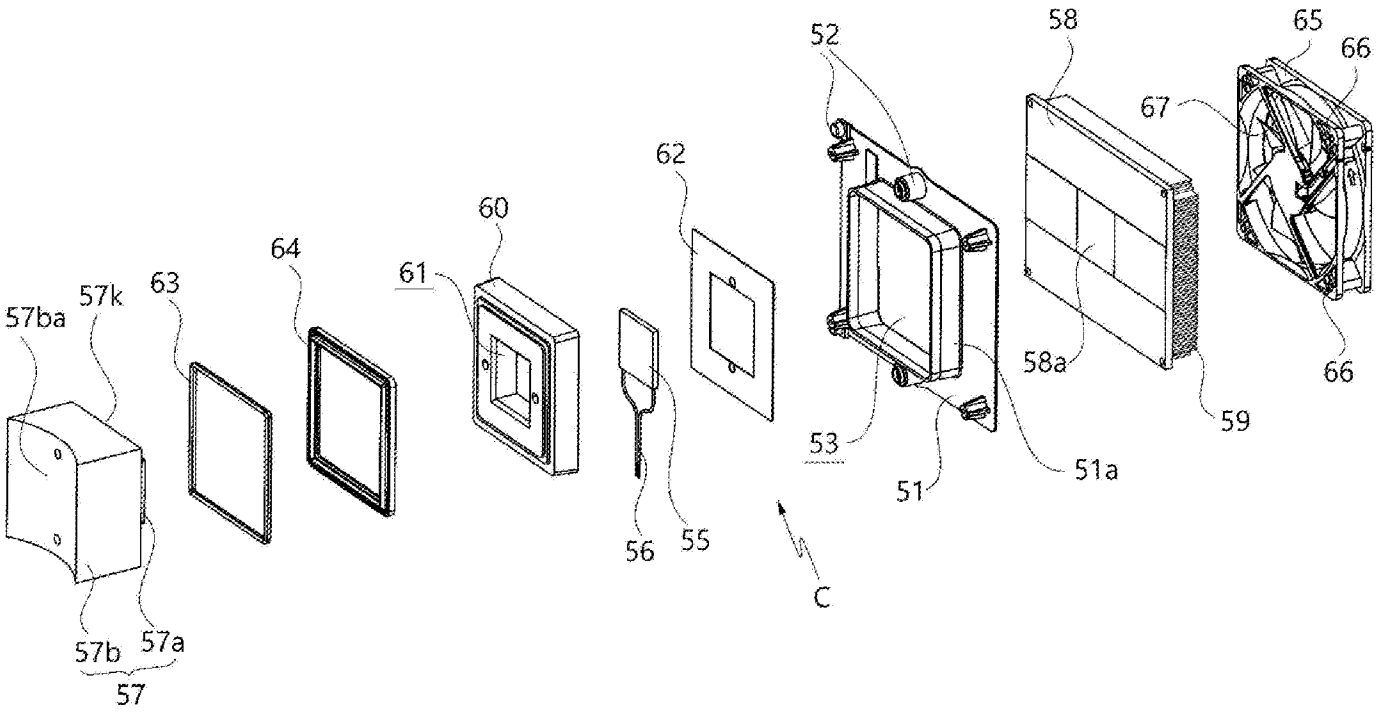
FIG. 14 is an exploded perspective view showing a cooler of the parts of the embodiment shown in FIG. 4.

In detail, referring to FIG. 14, the cooler C may be formed by assembling several parts. The cooler C may include an element housing 51 and the element housing 51 may form the frame of the cooler C. The element housing 51 may be a kind of rectangular frame and a receiving space 53 may be formed through the center of the element housing 51. Several parts including the thermoelectric element 55 may be disposed in the receiving space 53. The receiving space 53 may be defined inside a frame portion 51*a* protruding toward the thermoelectric element 55 from the element housing 51.

The element housing 51 may be made of a material that can minimize a loss of heat due to thermal conduction. For example, the element housing 51 may be made of a non-metallic material such as plastic. The element housing 51 may serve to prevent heat of a heat sink 58 from transferring to a cooling block 57 in cooperation with an insulating block 60 to be described below. Reference numeral '52' indicates several fastening bosses for fixing the element housing 51, and some of the fastening bosses may couple other parts to the element housing 51.

The thermoelectric element 55 may be disposed in the receiving space 53. The thermoelectric element 55 may have a low-temperature portion and a high-temperature portion, and the low-temperature portion and the high-temperature portion may be determined in accordance with the direction of a voltage that is applied to the thermoelectric element 55. The low-temperature portion of the thermoelectric element 55 may be positioned closer to the cooling guide 40 than the high-temperature portion. The low-temperature portion may be in contact with the cooling block 57 to be described below and the high-temperature portion may be in contact with the heat sink 58. The cooling block 57 may cool the cooling guide 40 and heat may be dissipated from the heat sink 58. Reference numeral '56' indicates a cable for applying power to the thermoelectric element 55.

The cooling block 57 may be in contact with the thermoelectric element 55. The cooling block 57 may be disposed between the thermoelectric element 55 and the cooling guide 40 with one side in contact with the cooling block 57 and the opposite side in contact with the cooling guide 40. Accordingly, the cooling block 57 may transmit the coldness of the low-temperature portion of the thermoelectric element 55 to the cooling guide 40.

The cooling block 57 has a substantially hexahedral 3D shape. In both sides of the cooling block 57, a first surface 57*aa* (see FIG. 15) that is a surface facing the thermoelectric element 55 and a second surface 57*ba* that is a surface facing the cooling guide 40 may have different areas. In the embodiment, the second surface 57*ba* is wider than the first surface 57*aa*. Accordingly, coldness of the thermoelectric element 55 may be transmitted to the wide area of the cooling guide 40. Further, since the first surface 57*aa* being in contact with the thermoelectric element 55 may be relatively small, space usability may be increased.

On the contrary, the second surface 57*ba* may be smaller in area than the first surface 57*aa*. In this case, a larger thermoelectric element 55 may be connected to the relatively wide first surface 57*aa* or several thermoelectric elements 55 may be in contact with the first surface 57*aa*, and the cooling guide 40 may be quickly cooled.

In the embodiment, the first surface 57*aa* of the cooling block 57 may be in direct contact with the thermoelectric element 55 and the second surface 57*ba* that is the opposite surface of the cooling block 57 may be in direct contact with the cooling guide 40. Alternatively, a separate medium may exist at any one of between the first surface 57*aa* and the thermoelectric element 55 or the second surface 57*ba* and the cooling guide 40. The medium may be made of a material with high thermal conductivity.

Meanwhile, the first surface 57*aa* that is the surface being in contact with the thermoelectric element 55 of the cooling block 57 and the second surface that is the surface facing the cooling guide 40 of the cooling block 57 may have different shapes. In the embodiment, the second surface 57*ba* facing the cooling guide 40 of the cooling block 57 may be curved, but the first surface 57*aa* facing the thermoelectric element 55 of the cooling block 57 may be flat. As described above, the first surface 57*aa* and the second surface 57*ba* may be formed to fit to the surface shapes of the contact objects (the thermoelectric element 55 and the cooling guide 57), respectively, the contact areas with the objects may be increased. Obviously, if the surface of the cooling guide 40 is flat, the surface of the cooling block 57 may also be flat and the first surface 57*aa* may also be curved rather than flat.

In the embodiment, the cooling block 57 may include a first block 57*a* being in contact with the thermoelectric element 55 and a second block 57*b* being in contact with the cooling guide 40. The first block 57*a* and the second block 57*b* may have different shapes with a stepped surface 57*k* therebetween. The first block 57*a* and the second block 57*b* may be integrated or may be separate parts.

The first block 57*a* may be a substantially rectangular parallelepiped and the second block 57*b* may have a larger cross-sectional area. The second block 57*b* may also be substantially a hexahedron, but the second surface 57*ba* facing the cooling guide 40 is a curved surface.

The first block 57*a* may protrude from the cooling block 57 toward the receiving space 53 of the element housing 51. The first block 57*a* is a rectangle when seen from the front. The first surface 57*aa* that is a surface of the first block 57*a* may be in close contact with the thermoelectric element 55. The first block 57*a* may press the thermoelectric element 55 toward the heat sink 58, whereby the thermoelectric element 55 may be fixed between the first block 57*a* and the heat sink 58.

Figure 15:
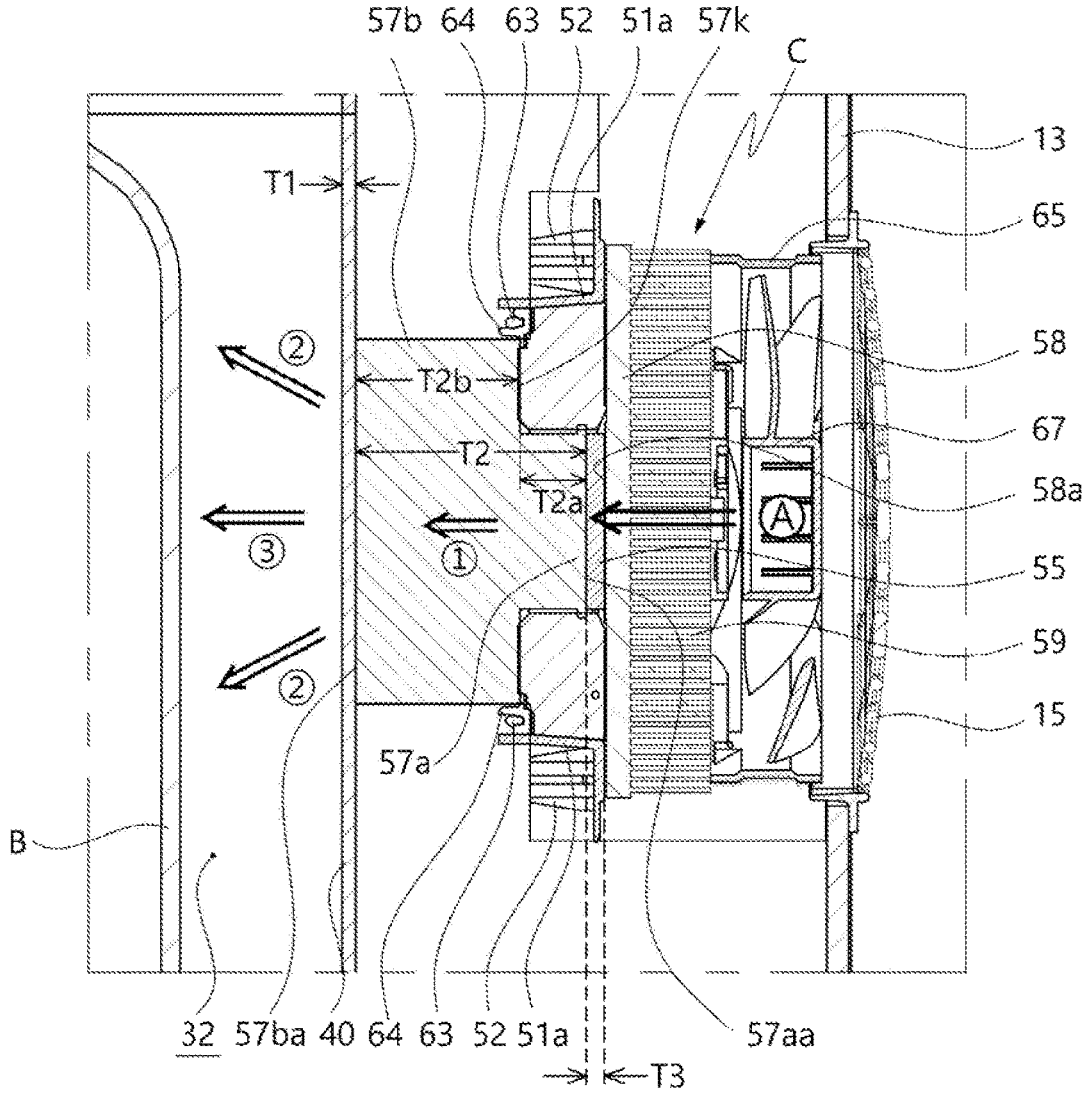
FIG. 15 is an enlarged cross-sectional view showing the cooler of FIG. 6.

As shown in FIG. 15, the thickness T2 of the entire cooling block 57 may be larger than the thickness T1 of the cooling guide 40. For reference, the thickness may be the front-rear width of the cabinet 10. Accordingly, an insulating portion G having a sufficient thickness and height may be secured around the cooling block 57, so the insulating performance of the refrigerator may be increased.

Further, when the thickness T2 of the cooling block 57 is larger than the thickness T1 of the cooling guide 40, the cooling block 57 may secure a sufficient distance between the cooling guide 40 and the thermoelectric element 55, so the temperature difference between the two regions may be maintained at a predetermined level or higher. Reference numeral 'T3' not stated is the thickness of the thermoelectric element 55 and the thickness T3 of the thermoelectric element 55 may be variously set.

In the embodiment, the thickness T2*b* of the second block 57*b* may be larger than the thickness T2*a* of the first block 57*a*. The cross-sectional area of the second block 57*b* may be larger than the cross-sectional area of the first block 57*a* and the second block 57 may be thicker than the first block. As described above, when the second block 57*b* is relatively thick, the cooling block 57 may secure a sufficient distance between the cooling guide 40 and the thermoelectric element 55 and it is advantageous in terms of maintaining the temperature difference between the two regions at a predetermined level or higher using the larger cross-sectional area of the second block 57*b*.

Referring to FIG. 6, the height H2 of the cooling block may be smaller than the height H1*a* of the cooling guide. The larger the height of the cooling block 57, the smaller the area occupied by the insulating portion G and the lower the insulating efficiency. Accordingly, in the embodiment, the height H1*a* of the cooling guide may be relatively large. Accordingly, the height of the insulating portion G surrounding the cooling block 57 may be large. For reference, the installation space S is an empty space in FIG. 6, but the installation space S may be filled with the insulating portion G.

Figure 16:
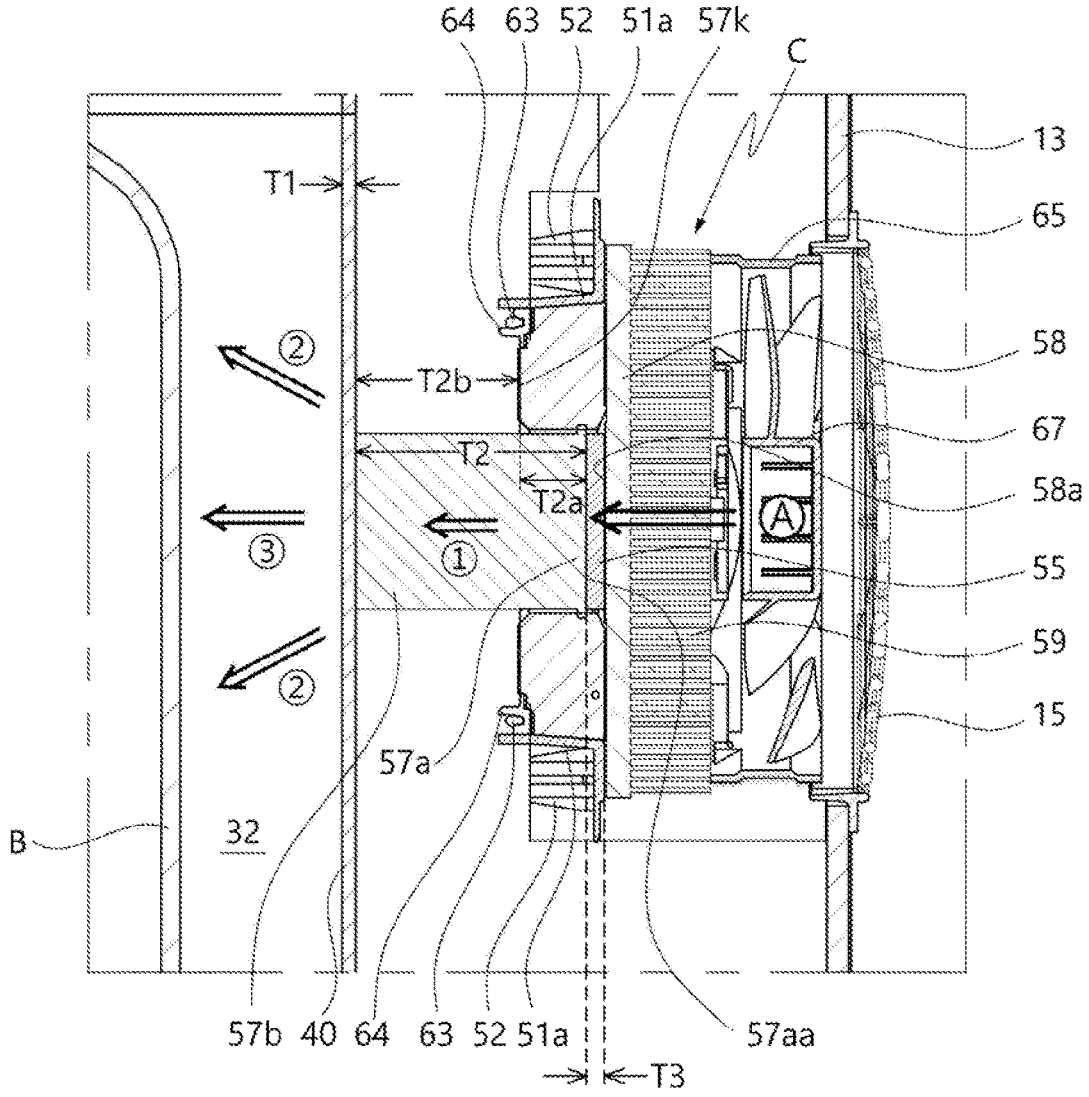
FIG. 16 is an enlarged cross-sectional view showing another embodiment of the cooler of a refrigerator for drinks according to the present disclosure.

FIG. 16 shows another structure of the cooling block 57. As shown in the embodiment of FIG. 16, the first block 57*a* and the second block 57*b* of the cooling block 57 may have the same cross-sectional area without a stepped portion. That is, the cooling block 57 may be substantially a rectangular parallelepiped or a polyprism or a circular cylinder.

However, even in this case, the shapes and areas of the first surface 57*aa* of the first block 57*a* and the second surface (not given reference number) of the second block 57*b* may be different from each other. Since the second surface may be in close contact with the cooling guide 40 having a curved shape, the second surface is curved. The first surface 57*aa* may be flat to be in surface contact with the surface of the thermoelectric element 55.

Meanwhile, the heat sink 58 may be disposed opposite to the cooling block 57 with the thermoelectric element 55 therebetween. The heat sink 58 may be in contact with the high-temperature portion of the thermoelectric element 55, thereby serving to dissipate heat of the high-temperature portion of the thermoelectric element 55. A heat dissipation fan 65 to be described below may be coupled to the heat sink 58, whereby the heat dissipation fan 65 may cool the heat sink 58.

As for the structure of the heat sink 58, the heat sink 58 may include a plate-shaped heat dissipation plate (not given reference numeral) and a plurality of heat dissipation fins 59. The heat dissipation fins 59 may be stacked with gaps therebetween. The heat dissipation plate may be a thin plate and may be in contact with the heat dissipation fins 59.

The heat dissipation plate may further include an element contact plate 58*a* for contact with the thermoelectric element 55. The area of the element contact plate 58*a* may be smaller than the area of the heat dissipation plate. For example, the element contact plate 58*a* may have a surface area that is substantially the same as the surface of the thermoelectric element 55. The element contact plate 58*a* may be exposed to the thermoelectric element 55 through the receiving space 53 of the element housing 51.

The cooler C may further include an insulating block 60 surrounding the thermoelectric element 55. The thermoelectric element 55 may be positioned inside the insulating block 60. The insulating block 60 may have an element mount hole 61 open forward and rearward and the thermoelectric element 55 may be positioned in the element mount hole 61.

The front-rear thickness of the insulating block 60 may be larger than the thickness of the thermoelectric element 55. The insulating block 60 may serve to increase the efficiency of cooling the thermoelectric element 55 by preventing the heat of the thermoelectric element 55 from being conducted to the edge of the thermoelectric element 55. The edge of the thermoelectric element 55 may be surrounded by the insulating block 60, whereby the heat transferring from the cooling block 57 to the heat sink 58 may not be dissipated around.

A back plate 62 may be disposed on the rear surface of the insulating block 60. The back plate 62 may be combined with the insulating block 60 to surround the edge of the thermoelectric element 55. The back plate 62, similar to the insulating block 60, may serve to increase the efficiency of cooling the thermoelectric element 55 by preventing the heat of the thermoelectric element 55 from being conducted to the edge of the thermoelectric element 55. The back plate 62 may be positioned in the receiving space 53 of the element housing 51.

A gasket 63 may be disposed at the close contact portion between the insulating block 60 and the cooling block 57. The gasket 63 may have an elastic material such as rubber. The gasket 63 may be formed in a rectangular ring shape, but is not limited thereto and the shape thereof may be changed in accordance with the shape of the insulating block 60. The gasket 63 may function as a sealing member and may prevent heat from being dissipated between the insulating block 60 and the cooling block 57. Reference numeral '64' indicates a holder for fixing the gasket 63.

The heat dissipation fan 65 may be coupled to the rear of the heat sink 58. The heat dissipation fan 65 may be disposed to face the heat sink 58 and may blow external air flowing inside through the air intake port to the heat sink 58. The heat dissipating fan 65 may include a fan 67 and a fan housing surrounding the outer side of the fan 67. The fan 67, for example, may be an axial fan. The fan 67 may be spaced apart from the heat sink 58. Accordingly, the flow resistance of the air blown by the heat dissipation fan 65 may be minimized and heat exchange efficiency at the heat sink 58 may be increased. The heat dissipation fan 65 may be fixed to the heat sink 58 by a fixing pin 66.

Though not shown, a fuse may be connected to the thermoelectric element 55, so when overvoltage is applied to the thermoelectric element 55, the fuse may cut the voltage that is applied to the thermoelectric element 55.

Referring to FIG. 5, the portion around the connection portion between the cooler C and the cooling guide 40 of the inner case 30, 40 may be filled with the insulating portion G. Accordingly, the insulating portion G may serve to increase the efficiency of cooling the thermoelectric element 55 by preventing the heat of the thermoelectric element 55 from being conducted to the edge of the thermoelectric element 55. As a result, the insulating 65 may be disposed 60 may primarily perform insulation by surrounding the edge of the thermoelectric element 55 and the insulating portion G may secondarily perform insulation by surrounding the edge of the cooler C.

Referring to FIGS. 4 and 6, the cabinet 10 has a dispenser nozzle 70. The dispenser nozzle 70 may be a part that dispenses a drink from the drink container B in the storage compartment 32, and may be disposed on the front surface of the cabinet 10 in the embodiment. The same number of dispenser nozzles 70 as the number of storage compartments 32 may be provided, and two dispenser nozzles 70 may be provided in the embodiment. The dispenser nozzles 70 may be used to supply the drinks in the drink containers B in different storage compartments 32, respectively.

The dispenser nozzle 70 may include a connection pipe 72 connected to the cabinet 10 and a dispenser head 71 connected to the connection pipe 72 and extending in the height direction of the refrigerator. An outlet 75 may be formed inside the dispenser head 71, so the drink in the drink container B may be supplied through the outlet 75.

For reference, though not shown, when the internal pressure of the drink container B is increased by injecting air into the drink container B, the drink in the drink container B may be supplied outside through the connection pipe 72 and the outlet 75. To this end, an air pump may be installed in the installation space S and may increase the internal space of the drink container B through a gas supply pipe.

A front panel 80 is disposed close to the dispenser nozzles 70 and a display 83 may be disposed on the front panel 80. The front panel 80 may be disposed at the upper portion on the front surface of the cabinet 10 and may have a flat plate shape. In the embodiment, the front panel 80 may be positioned inside the second panel 44 positioned relatively outside of the insulating panel 42 described above, but the second panel 44 may be vertically shorter than the front panel 80 and the other portion may be filled with the front panel 80.

The display 83 may be disposed on the front panel 80. The display 83 may provide the information of the refrigerator or may provide an interface for inputting instructions, and in the embodiment, the display 83 may be a type enabling touch input. Various items of information such as the temperatures of the storage compartments 32, the storage periods of the stored drinks, and the kinds of drinks may be displayed through the display 83. A user may input temperatures of the storage compartments 32, internal brightness, turning-on/off of the refrigerator, etc. through the display 83.

The display 83 may be installed in the mount space 36*a* described above. Referring to FIG. 6, the mount space 36*a* that may be an empty space may be positioned behind the front panel 80 and the display 83 may be installed in the mount space 36*a*. Obviously, not only the display 83, a circuit board and a wire harness for control may be installed in the mount space 36*a*.

The front panel 80 may be disposed at the same height as the dispenser nozzles 70. More specifically, through-holes (not shown) through which the connection pipes 72 of the dispenser nozzles 70 pass may be formed through the front panel 80, whereby the connection pipes 72 may be connected to the insides of the storage compartments 32 through the through-holes.

The inlet Ba of the drink container B may be fitted to the cover assembly 90 in an open state. The cover assembly 90 may serve to close the inlet Ba of the drink container B and to close the open hole 22 at the center of the upper cover 20. When a user lifts the cover assembly 90, the drink container B fitted to the cover assembly 90 may also be taken out of the storage compartment 32, or a user may fit the drink container B to the cover assembly 90 and then may insert the drink container B into the storage compartment 32. Accordingly, the cover assembly 90 may function as a kind of handle.

As for the configuration of the cover assembly 90, the cover assembly 90 may have a cover plate 91 configured to close the open hole 22, and a pressing portion 93 extending downward from the cover plate 91 to have the inlet Ba of the drink container B fitted therein. A handle 95 may be rotatably coupled to the cover plate 91, so when the handle 95 is rotated upward, as shown in FIG. 3, a user may hold the handle.

The cover plate 91 may be formed to fit to the shape of the open hole 22 and may have a flat plate shape. As shown in FIG. 6, the pressing portion 93 of the cover plate 91 may protrude downward from the cover plate 91 and may be slightly inserted in the open hole 22, in detail, in the storage compartment 32. The inlet Ba of the drink container B may be fitted in the pressing portion 93, whereby it may be closed.

The handle 95 may be erected to move the drink container B fitted in the cover assembly 90, as shown in FIG. 3, but may be rotated to form a continuous plane with the cover plate 91 after the drink container B is stored in the storage compartment 32. That is, the handle 95 may be considered as a part of the cover plate 91. Though not shown, when the handle 95 is rotated upward, as shown in FIG. 3, a portion of the handle 95 may deform the pressing portion 93, whereby the inlet of a bottom may be strongly pressed and fixed in the pressing portion 93.

A drink supply pipe (not shown) may be disposed in the cover plate 91. The drink supply pipe may have one side that may be inserted in the drink container B and an opposite side connected to the dispenser nozzle 70, thereby serving to deliver the drink in the drink container B to the dispenser nozzle.

When a gas supply pipe (not shown) connected with an air pump other than the drink supply pipe is formed in the cover plate 91, the internal space of the drink container B may be increased by injecting gas into the internal space (empty space) of the drink container B through the gas supply pipe, or it may be possible to prevent oxidation of a drink by injecting an inert gas.

Referring to FIG. 15, as for the process of cooling the storage compartment 32, when power is supplied to the thermoelectric element 55, coldness generated at the low-temperature portion (the left side of the thermoelectric element 55 in the figure) may be transmitted to the cooling block 57 (in the direction of the arrow ①). Substantially, the cooling block 57 and the low-temperature portion of the thermoelectric element 55 exchange heat, but the transmission direction of coldness is shown.

When the temperature of the cooling block 57 decreases, the temperature of the entire cooling guide 40 being in contact with the cooling block 57 may decrease. Since the second surface 57*ba* facing the cooling guide 40 of the cooling block 57 may be curved, as described above, a contact area with the cooling guide 40 may be sufficiently secured, so heat may be effectively exchanged between the cooling guide 40 and the cooling block 57.

The temperature of the cooling guide 40 may decrease along the surface (in the direction of the arrow ②) and the cooling guide 40 may be made of a material having high thermal conductivity such as copper or aluminum, so the entire cooling guide 40 may be cooled. When the temperature of the cooling guide 40 decreases, the cooling guide 40 may cool the storage compartment 32 while exchanging heat with the air in the storage compartment 32.

Since the cooling guide 40 may surround at least a portion of the storage compartment 32 and may have a curved surface surrounding the surface of the drink container B, the cooling guide 40 may effectively transmit coldness to the surface of the drink container B (in the direction of the arrow 3). That is, the cooler C may not cool the entire space in the refrigerator, but may cool the cooling guide 40 itself surrounding the drink container B, so the cooling efficiency of the refrigerator may be improved.

Next, a process of dissipating heat from the cooler C is described with reference to FIG. 6. Air flowing inside through the air intake port of the intake grille 15 may be discharged to the heat sink 58 (in the direction of the arrow A) by the heat dissipation fan 65. When the external air is sent to the heat sink 58, the temperature of the heat sink 58 being in close contact with the high-temperature portion of the thermoelectric element 55 decreases. Since the heat sink 58 may have a plurality of heat dissipation fins 59, a very wide contact area with the external air may be secured.

The air heated by removing heat from the cooler C may be discharged out of the refrigerator (in the direction of the arrow B). More specifically, the air in the refrigerator may be discharged through the air discharge port of the discharge grille 16. In the embodiment, since the air discharge port may be formed at the upper portion of the rear plate 13, air may be discharged at the upper portion, but the air discharge port may be formed at the lower portion of the rear plate 13.

The spacer 14 of the rear plate 13 may keep a distance between the rear plate 13 and a wall, so air may smoothly flow inside and outside.

Meanwhile, in the embodiment, the refrigerator may have two storage compartments 32 and the cooler C may be individually installed for each of the storage compartments 32. The coolers C may be independently controlled. Accordingly, it may be possible to set different temperatures for the storage compartments 32, and for example, when a drink is wine, it may be possible to set an appropriate temperature in accordance with the kind such as the type of the wine. That is, a user may control the temperature of drinks in accordance with the features of the drinks or his/her taste.

Figure 17:
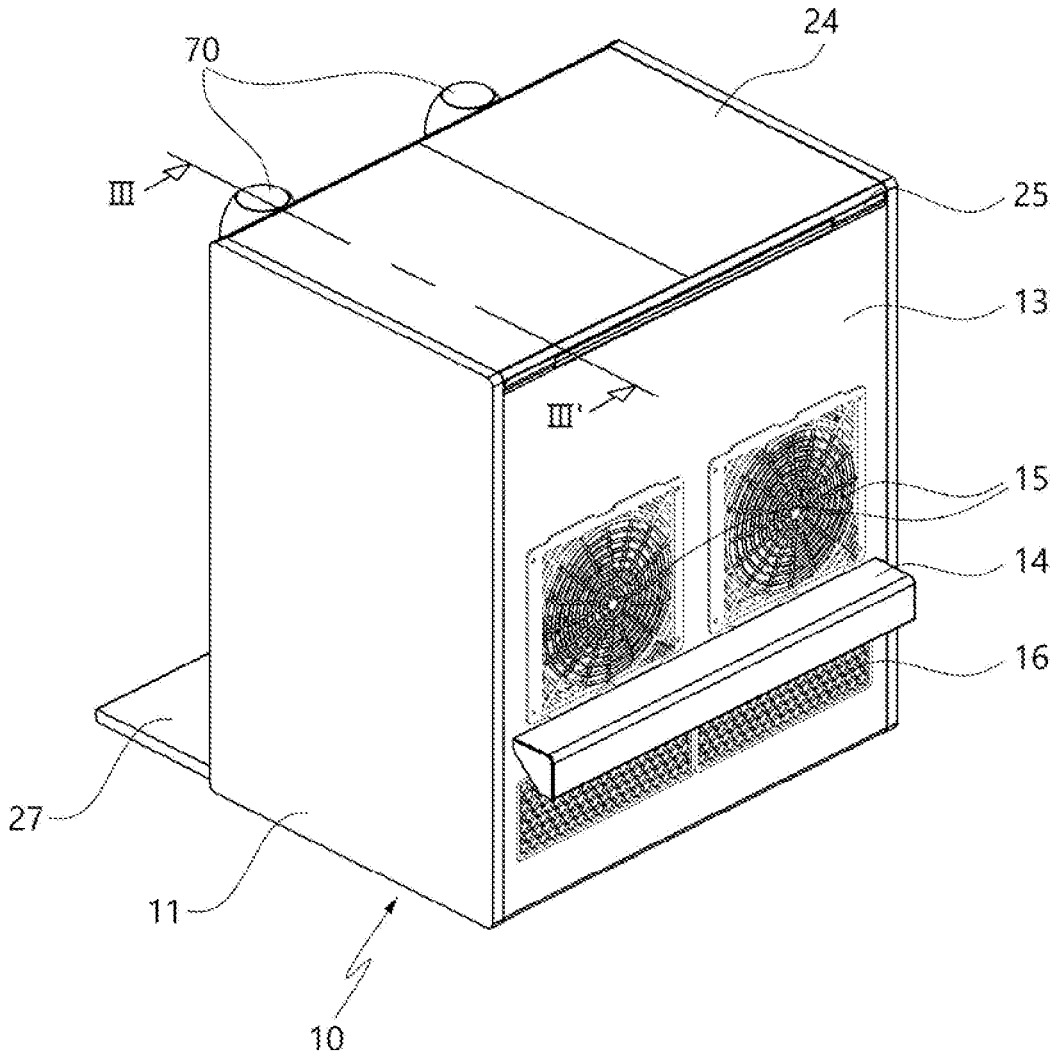
FIG. 17 is a perspective view showing the configuration of the rear surface of another embodiment of a refrigerator for drinks according to the present disclosure.

Another embodiment is shown in FIGS. 17 to 23. The same components as those in the previous embodiment are not described and differences are mainly described. First, FIG. 17 shows the rear configuration of a refrigerator.

As shown in the figure, a pair of intake grilles 15 providing air intake ports may be disposed on the rear plate 13 and a discharge grille 16 providing an air discharge port may be disposed under the intake grilles 15. The pair of intake grilles 15 may be installed at positions corresponding to a pair of coolers C. Obviously, the air intake port and the air discharge port may be directly formed at the rear plate 13 without the intake grille 15 and the discharge grille 16.

The rear plate 13 may have a spacer 14. The spacer 14 may protrude outward, that is, away from the installation space S of the refrigerator from the rear plate 13. The spacer 14, which is provided to keep a distance between the rear plate 13 and the wall of an installation place where the refrigerator is installed, may be elongated to the left and right, as shown in FIG. 17. The spacer 14 may naturally form an air flow space between the rear plate 13 and the wall of an installation place. The spacer 14 may function as a kind of handle. That is, a user may move the refrigerator with the spacer 14 by hand.

In this embodiment, the spacer 14 may be positioned between the intake grilles 15 and the discharge grille 16. When the spacer 14 is positioned between the intake grilles 15 and the discharge grille 16, it may be possible to prevent air discharged to the air discharge port from directly flowing into the air intake port and to increase thermal efficiency. That is, the spacer 14 may block the portion between the air discharge port and the air intake port, and to this end, the spacer 14 may be disposed across the portion between the air intake port and the air discharge port in the embodiment.

Figure 19:
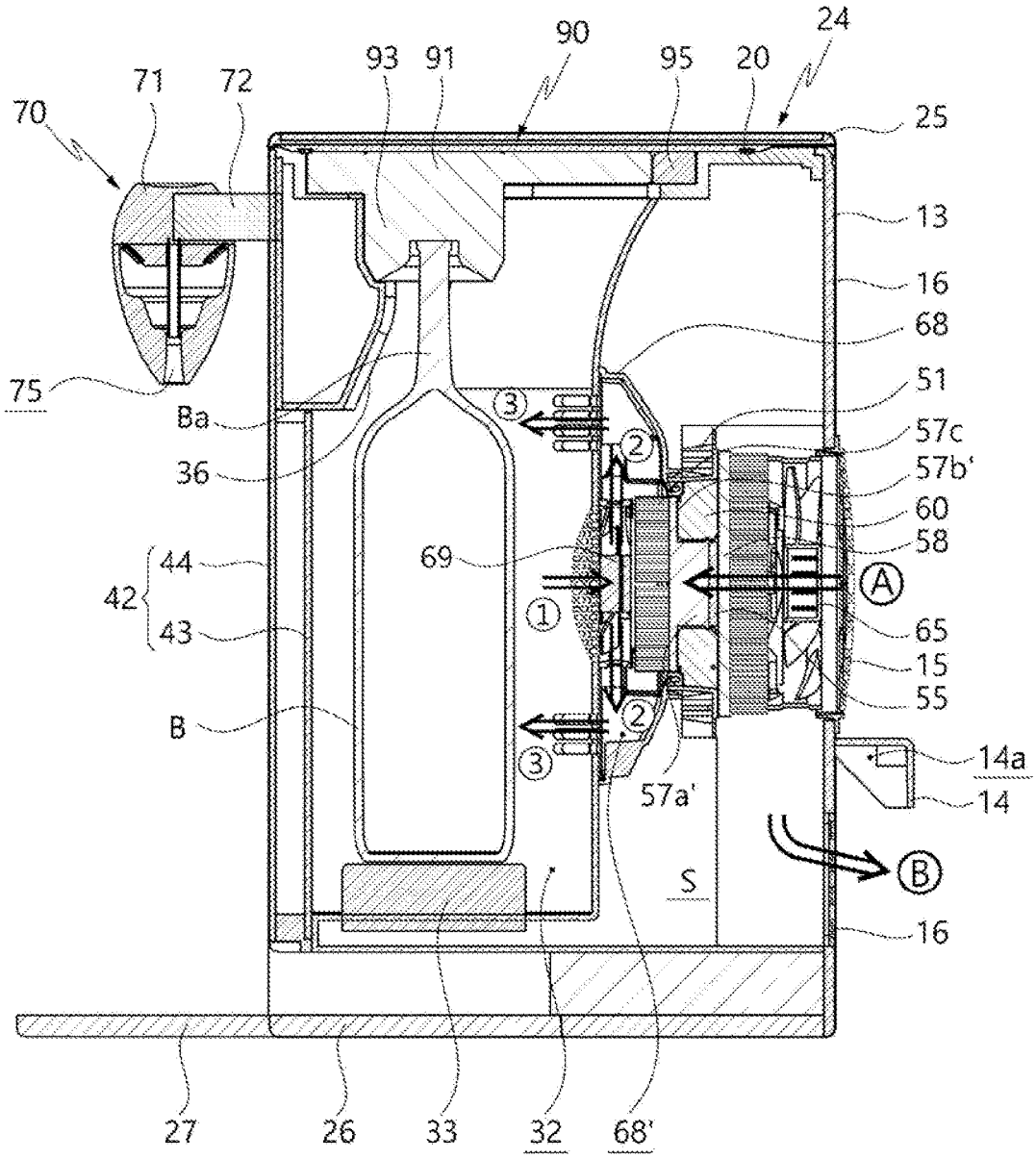
FIG. 19 is a cross-sectional view taken along line III-III' of FIG. 17.

Referring to FIG. 19 that is a cross-sectional view, the spacer 14 may have a blocking space 14*a* open downward. The blocking space 14*a* may be open downward toward the air discharge port and may be closed to the top and the side facing a wall (the right side in the figure). Accordingly, air discharged through the air discharge port may be naturally guided downward without flowing up to the air intake port.

Figure 18:
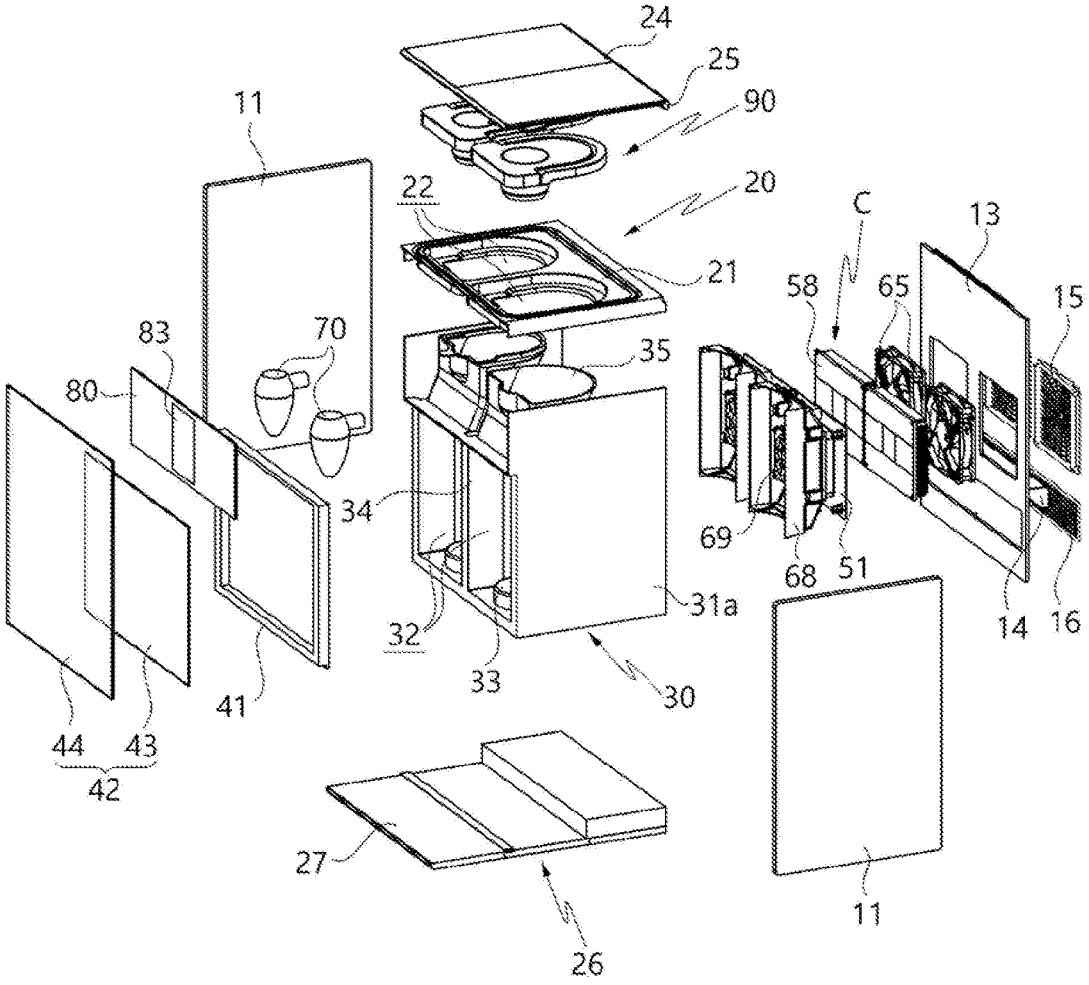
FIG. 18 is an exploded perspective view showing the parts of the embodiment shown in FIG. 17.
Figure 20:
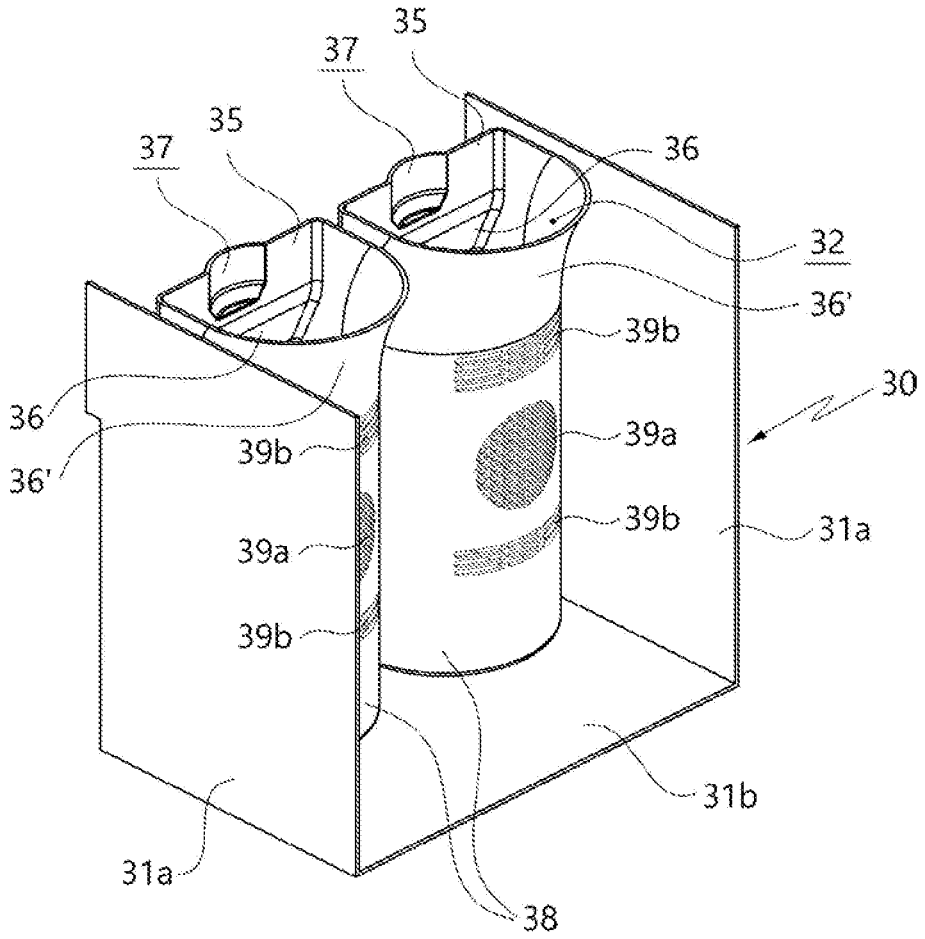
FIG. 20 is a perspective view showing the configuration of an inner case of the embodiment shown in FIG. 18.

The structure of the inner case 30 is shown in FIGS. 18 and 20. The inner case 30 may have a three-dimensional structure surrounding the storage compartments 32 with respect the storage compartment 32 at the center. The inner case 30 may have substantially a hexahedron shape in the embodiment, but is not limited thereto. The inner case 30 may be entirely or at least partially made of a nonmetallic material. In the embodiment, the inner case 30 may be made of a nonmetallic material such as synthetic resin. Obviously, the inner case 30 may be entirely or partially made of metal.

Referring to FIG. 20, the frame of the inner case 30 may be formed by a pair of sides 31*a* and a bottom 31*b* connecting the sides 31*a* and forming the floor. Insertion guides 35 may be disposed inside the inner case 30 surrounded by the pair of sides 31*a* and the bottom 31*b*. The insertion guide 35 may surround at least a portion of the drink container B and it may be considered that an inlet of the storage compartment 32 is formed inside the insertion guide 35. A partition wall 34 may vertically extend between the pair of insertion guides 35, thereby serving to separate the storage compartments 32.

In the embodiment, the insertion guides 35 may be disposed between the pair of sides 31*a* and each may have, at the lower portion, an insertion body 38 having a substantially partially cut cylindrical shape and elongated vertically, that is, in the height direction of the a drink container B. Accordingly, a horizontal cross-section of the insertion body 38 may have a substantially D-shape with an open front. The open portion of the insertion body 38 may be closed by the first panel 43 of the insulating panel 42. The insertion body 38 may be considered as a part of the insertion guides 35.

For reference, the insertion body 38 may have similar or the same shape as the cooling guide 40 in the previous embodiment, so it may be considered as the same component. That is, the insertion body 38 may be considered as the cooling guide 40, but for discrimination, it may be referred to as an insertion body 38 and given a specific reference numeral below.

In the embodiment, the insertion body 38 itself may not need to be cooled, so it may not need to be made of a material having high thermal conductivity. Accordingly, the insertion body 38 may be integrated with the insertion guide 35 to have a continuous shape together.

The front of the insertion guide 35, which faces the front of the cabinet 10, may form the front surface of the insertion guide 35. The front of the insertion guide 35 and the inner surface of the cabinet 10 may be spaced apart from each other, whereby a mount space 36*a* may be formed. The mount space 36*a* may be a portion in which a display, etc. may be installed. The structures of the front 36, the mount space 36*a*, the extension 36', and the seat groove 37 may be similar to those of the previous embodiment, so they are not described.

In the embodiment, unlike the previous embodiment, the entire of the insertion guide 35 and insertion body 38 may be made of synthetic resin having low thermal conductivity without a separate cooling guide 40. In the embodiment, as will be described below, since the cooler C may cool the storage compartment 32 in the inner case 30 without cooling the inner case 30 itself, the inner case 30 may not be necessarily made of a material having high thermal conductivity.

The insertion body 38 connected to the insertion guide 35 may have a substantially arc-shaped horizon cross-section. The insertion body 38 may be open forward, so the storage compartment 32 may open forward, but the first panel 43 of the insulating panel 42 may be coupled to the front of the storage compartment 32, so the storage compartment 32 may be closed. The insulating panel 42 may be disposed on the front surface of the inner case 30 opposite to the cooler C with the storage compartments 32 therebetween and may be made of an insulating material in a flat plate structure. Since the structure of the insulating panel 42 was described in the previous embodiment, it is not described in detail.

As described above, the insertion body 38 of the inner case 30 may be formed in an arc shape rather than a polygon and may vertically extend without a change in shape. Accordingly, the storage 32 may also maintain the same shape in the height direction of the drink container B and temperature may be uniformly distributed in the storage compartment 32. Accordingly, the possibility of a large temperature difference in the height direction of the storage compartment 32 may be prevented by the shape of the insertion body 38.

Circulation holes 39*a* and 39*b* may be formed at the insertion body 38. The circulation holes 39*a* and 39*b* may be formed through the insertion body 38. The circulation holes 39*a* and 39*b* may include an exhaust hole 39*a* and a cooling hole 39*b* formed at different positions. The exhaust hole 39*a* may be a hole for discharging the air in the storage compartment 32 to the cooler C and the cooling hole 39*b* may be a hole for discharging the air cooled by the cooler C into the storage compartment 32. In the embodiment, the cooling hole 39*b* may be formed over and under the exhaust hole 39*a*.

In the embodiment, the cooling hole 39*b* may be disposed over and under the exhaust hole 39*a*. Accordingly, coldness entering the storage compartment 32 through the cooling holes 39*b* may flow in the height direction of the storage compartment 32 and then may be naturally discharged through the exhaust hole 39*a* at the center. Further, the heat transfer efficiency into the storage compartment 32 may be increased.

Obviously, alternatively, the circulation holes 39*a* and 39*b* may be disposed in the left-right direction perpendicular to the height direction of the storage compartment 32 rather than the height direction. That is, the cooling holes 39*b* may be disposed at the left and right sides of the exhaust hole 39*a*.

The circulation holes 39*a* and 39*b* may be surrounded by a fan shroud 68 of the cooler C to be described below and may be positioned in a circulation space 68' defined by the inner surface of the fan shroud 68 and the surface of the insertion body 38. Accordingly, air may flow only in the circulation space 68' without spreading around while circulating.

Figure 21:
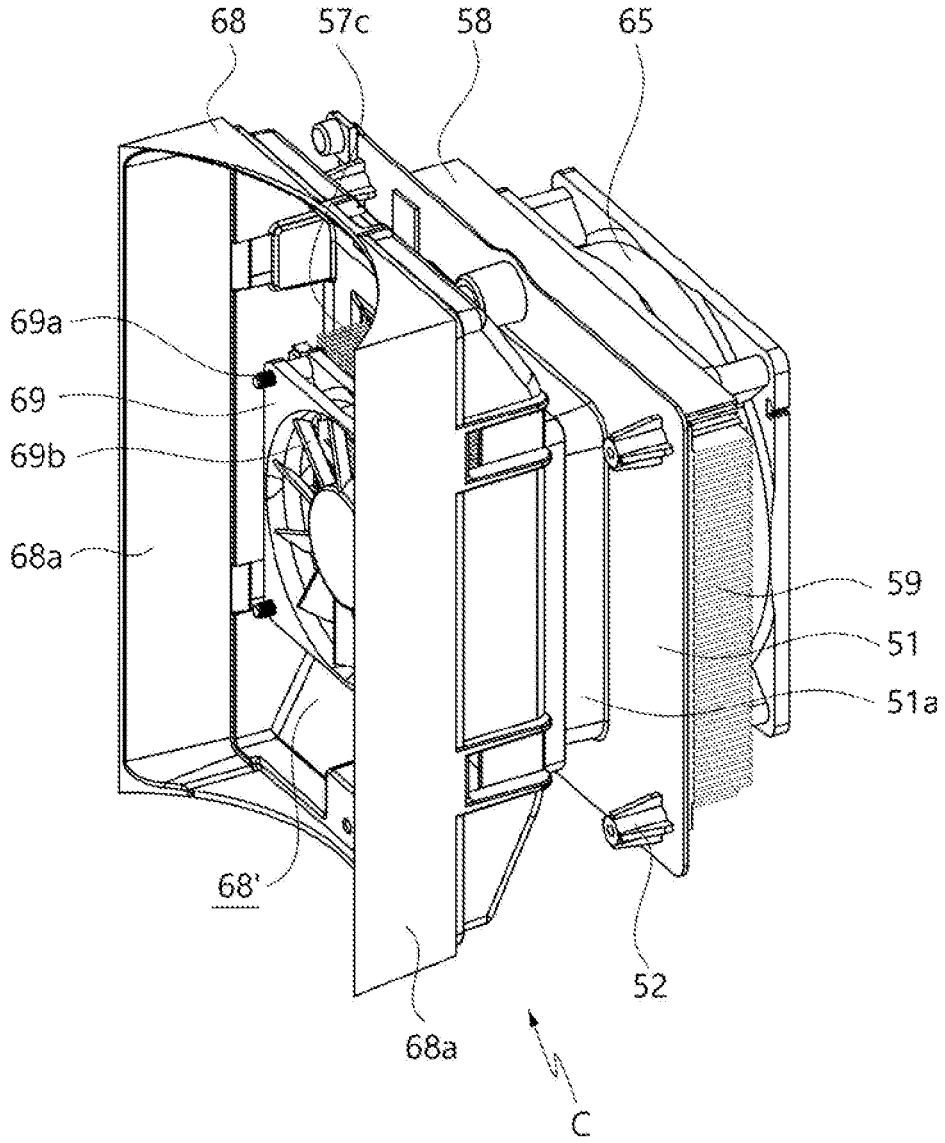
FIG. 21 is an enlarged perspective view showing the cooler of FIG. 19.
Figure 22:
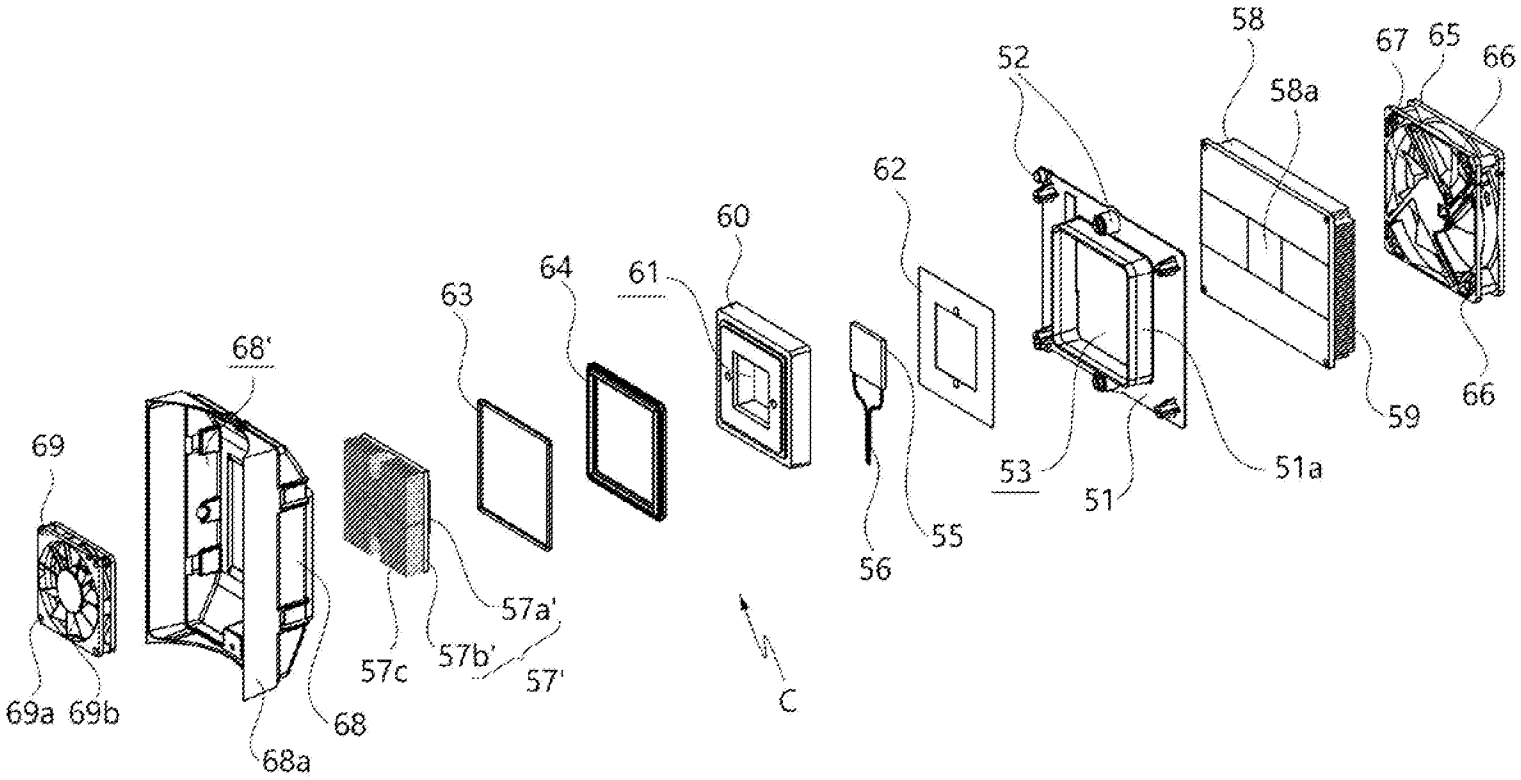
FIG. 22 is an exploded perspective view showing the cooler shown in FIG. 22.
Figure 23:
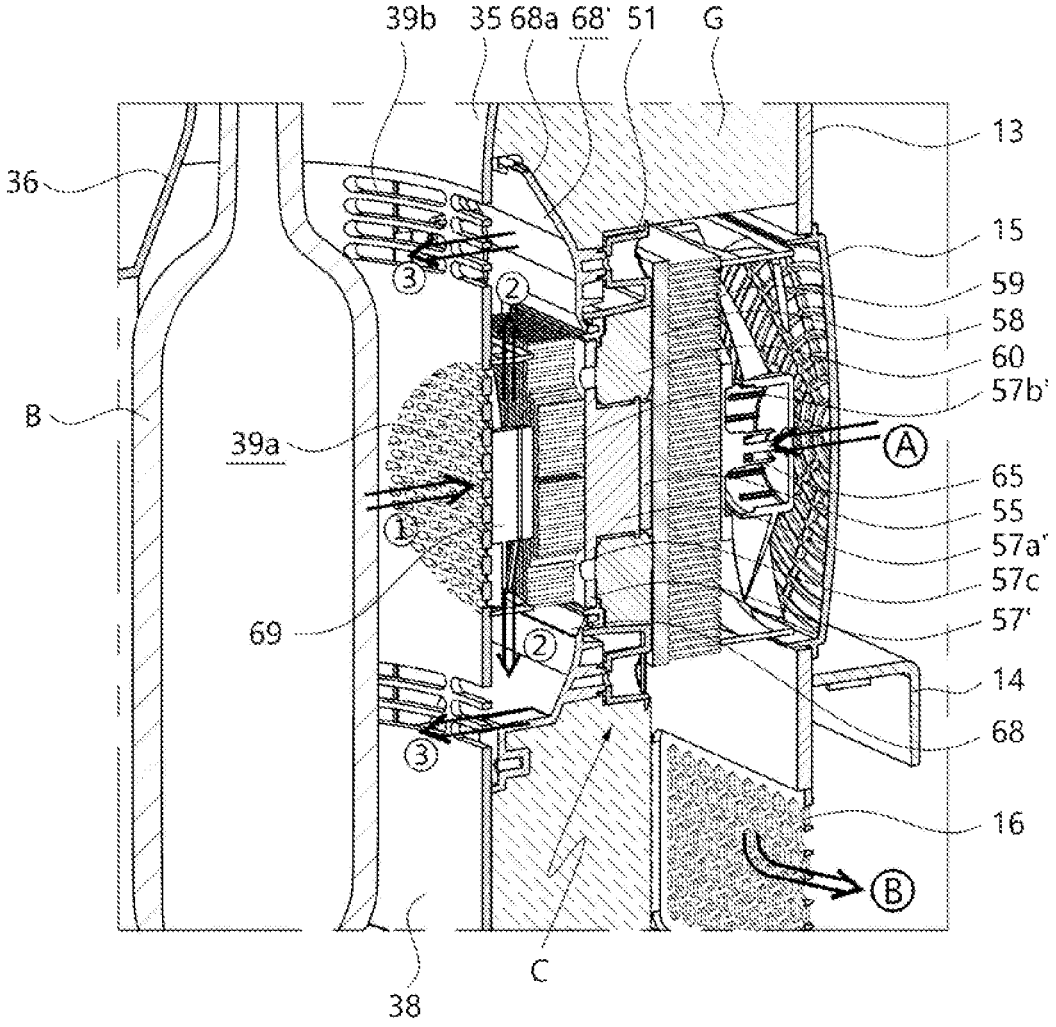
FIG. 23 is a perspective view showing the configuration of the cooler of the parts of the embodiment shown in FIG. 18.

The cooler C is shown in FIGS. 21 to 23. For reference, the same parts as those in the embodiment described above are not described. The cooler C may cool the cooling guide 40 itself that may be a part of the inner case 30 in the previous embodiment, but the cooler C may be operated to reduce the temperature of the storage compartment 32 in this embodiment.

The cooler C may include a cooling sink 57'. The cooling sink 57' may be disposed between the thermoelectric element 55 and the insertion body 38 in close contact with the thermoelectric element 55. Accordingly, the cooling sink 57' may transmit the coldness of the thermoelectric element 55 to the storage compartment 32. The cooling sink 57', similar to the cooling block 57 described above, may be in charge of heat exchange of the thermoelectric element 55 and the insertion body 38 in close contact with the thermoelectric element 55. Accordingly, the cooling sink 57' may also be considered as the cooling block 57, but for discrimination, it may be referred to as the cooling sink 57' below.

In more detail, the cooling sink 57' has a plate-shaped sink body **57*b*' and several cooling fins 57*c* may be formed on the sink body 57*b*' toward the insertion body 38. The cooling fins 57*c* may be spaced apart from each other and may extend in parallel with each other, thereby increasing the friction area with air. For reference, the cooling fins 57*c* may protrude in the opposite direction to the heat dissipation fins 59 of the heat sink 58**.

The cooling sink 57' may have a cooling protrusion **57*a*' and the cooling protrusion 57*a*' may protrude in the opposite direction to the cooling fins 57*c*. The protrusive surface of the cooling protrusion 57*a*' may be flat and may be in contact with the thermoelectric element 55. The cooling protrusion 57*a*' may protrude inside the element mount hole 61 of the insulating block 60, whereby it may press the thermoelectric element 55 toward the heat sink 58**.

The cooling sink 57' may be coupled to the cooling fan 69. The cooling fan 69 may be positioned closer to the insertion body 38 than the cooling sink 57'. The cooling fan 69 may serve to suction the air in the storage compartment 32 and discharge the air toward the cooling sink 57'. The cooling fan 69 has fan-coupling holes **69*a* for coupling the cooling fan 69 to the fan shroud 68 or surrounding parts, and reference numeral '69*b*' indicates a fan and the fan 69*b*** may be an axial fan.

In the embodiment, the cooler C may include the fan shroud 68 and the fan shroud 68 may be disposed on the insertion body 38. As shown in FIG. 23, the circulation space 68' connected with the circulation holes **39*a* and 39*b* may be defined between the fan shroud 68 and the surface of the insertion body 38, and the cooling fan 69 may be disposed in the circulation space 68'. Accordingly, the cooling fan 69 may be positioned between the surface of the insertion body 38 and the cooling sink 57'**.

The fan shroud 68 may have closing portions **69*a* surrounding at least a portion of the surface of the insertion body 38. Since the surface of the insertion body 38 may be curved, the closing portions 68*a* may also have a corresponding shape. That is, when the fan shroud 68 is coupled to the insertion body 38, ends of the closing portions 68*a* come in close contact with the surface of the insertion body 38**, whereby air may not leak between them.

Though not shown, the cooler C may further include a defrosting sensor. The defrosting sensor may be disposed on the cooling fan and may sense whether defrosting is required.

A process in which the storage compartment 32 is cooled in the embodiment is described with reference to FIG. 23. First, when the cooling fan 69 is operated, the air in the storage compartment 32 is suctioned. The suctioned internal air of the storage compartment 32 flows into the circulation space 68' through the exhaustion hole **39*a* of the circulation holes 39*a* and 39*b* and then may be sent to the cooling sink 57'** (in the direction of the arrow ①).

The cooling sink 57' may be in close contact with the thermoelectric element 55, so when power is supplied to the thermoelectric element 55, the coldness generated at the low-temperature portion (the left side of the thermoelectric element 55 in the figure) is transmitted to the cooling sink 57'. Accordingly, the cooling sink 57' may come in contact with the air of the storage compartment 32 on one side and may be in contact with the low-temperature portion of the thermoelectric element 55 on the opposite side, thereby enabling heat exchange between the air and the low-temperature portion.

The air decreased in temperature by exchanging heat through the cooling sink 57' may be spread outside the circulation space 68' (in the direction of the arrow ②) defined by the fan shroud 68, which may be generated by the cooling fan 69. The air may be supplied back into the storage compartment (in the direction of the arrow ③) through the cooling hole **39*b* of the circulation holes 39*a* and 39*b*. Accordingly, the temperature of the storage compartment 32 decreases. Further, the temperature of the storage compartment 32** may decrease while such air circulation is continuously generated.

Since the insertion body 38 may surround the storage compartment 32 and may have curved surface surrounding the surface of the drink container B, the holder guide may effectively transmit coldness to the surface of the drink container B.

Next, a process of dissipating heat from the cooler C is described. Air flowing inside through the air intake port of the intake grille 15 may be discharged to the heat sink 58 (in the direction of the arrow A) by the heat dissipation fan 65. When the external air is sent to the heat sink 58, the temperature of the heat sink 58 being in close contact with the high-temperature portion of the thermoelectric element 55 decreases. Since the heat sink 58 may have a plurality of heat dissipation fins 59, a very wide contact area with the external air may be secured.

The air heated by removing heat from the cooler C may be discharged out of the refrigerator (in the direction of the arrow B). More specifically, the air in the refrigerator may be discharged through the air discharge port of the discharge grille 16. In the embodiment, since the air discharge port may be formed at the lower portion of the rear plate 13, air may be discharged at the lower portion, but the air discharge port may be formed at the upper portion of the rear plate 13.

The spacer 14 of the rear plate 13 may keep a distance between the rear plate 13 and a wall, so air may smoothly flow inside and outside. Since the spacer 14 may be positioned between the intake grilles 15 and the discharge grille 16, it may be possible to prevent air discharged to the air discharge port from directly flowing into the air intake port. Accordingly, air discharged through the air discharge port may be naturally guided downward without flowing up to the air intake port.

Meanwhile, in the embodiment too, the refrigerator may have two storage compartments 32 and the cooler C may be individually installed for each of the storage compartment 32. The coolers C may be independently controlled. Accordingly, it may be possible to set different temperatures for the storage compartments 32, and for example, when a drink is wine, it may be possible to set an appropriate temperature in accordance with the kind such as the type of the wine. That is, a user may control the temperature of drinks in accordance with the features of the drinks or his/her taste.

What is claimed is:

1. A refrigerator, comprising:

a cabinet configured to store a drink container therein;

a cooling guide located in the cabinet;

a cooler located in the cabinet, the cooler being configured to cool the cooling guide, the cooler including:

a thermoelectric element; and a cooling block located between the thermoelectric element and the cooling guide to exchange heat;

a dispenser nozzle disposed to be at least partially exposed outside the cabinet and configured to be connected to the drink container to be able to supply a drink in the drink container to outside the cabinet; and an inner case located in the cabinet, wherein the cooling guide includes:

a first guide connected to the cooler, the first guide defining a rear portion of a storage compartment configured to store the drink container, the first guide having a pair of ends; and a pair of second guides connected to the pair of ends of the first guide, respectively, the pair of second guides including a pair of second ends extending toward a front surface of the cabinet, wherein a space between the pair of second guides is opened forward through an insulating panel disposed in front of the storage compartment, wherein the first guide has a curved surface facing the drink container, wherein the pair of second guides are respectively disposed opposite to one another with the drink container interposed therebetween, wherein a pair of first ends of the pair of second guides are connected to the pair of ends of the first guide, respectively, wherein the pair of second ends of the pair of second guides face the insulating panel, and wherein the inner case includes:

an inner frame forming an insulating portion partitioned from the storage compartment therein, the inner frame having an opening opposite the first guide and facing the insulating panel; and the cooling guide coupled to the inner frame at a different height from an insertion guide of the inner frame, the cooling guide defining the storage compartment together with the insulating panel.

2. The refrigerator of claim 1, wherein the cooling block has a first surface that faces the thermoelectric element and a second surface that faces the cooling guide, the first surface and the second surface have different surface areas, and wherein the second surface of the cooling block is wider than the first surface of the cooling block.

3. The refrigerator of claim 1, wherein the cooling block has a first surface in contact with the thermoelectric element and a second surface in contact with the cooling guide, and wherein a contact area between the cooling block and the cooling guide is larger than a contact area between the cooling block and the thermoelectric element.

4. The refrigerator of claim 1, wherein the cooling block includes a first block being in contact with the thermoelectric element and a second block being in contact with the cooling guide, the first block and the second block having different shapes such that a stepped surface is provided therebetween.

5. The refrigerator of claim 1, wherein a thickness of the cooling block in a front-rear direction of the refrigerator is larger than a thickness of the cooling guide in the front-rear direction of the refrigerator, and wherein a height of the cooling block is smaller than a height of the cooling guide.

6. The refrigerator of claim 1, wherein at least a portion of the storage compartment is located in the inner case.

7. The refrigerator of claim 6, wherein a portion around the storage compartment is filled with the insulating portion, and wherein the cooling guide is located between the insulating portion and the storage compartment to prevent the insulating portion from being exposed to the storage compartment.

8. The refrigerator of claim 7, wherein the storage compartment is provided in plurality, and wherein the storage compartments are separated by the insulating portion such that the storage compartments define independent spaces.

9. The refrigerator of claim 8, wherein the cooler is provided in plurality such that each storage compartment of the plurality of storage compartments is provided with a respective cooler.

10. The refrigerator of claim 2, wherein the second surface of the cooling block is curved to be in surface contact with a surface of the first guide.

11. The refrigerator of claim 1, wherein the pair of second ends of the pair of second guides are spaced from the first guide and define an open portion therebetween, and wherein the insulating panel covers the open portion.

12. The refrigerator of claim 1, wherein the pair of second ends of the pair of second guides are spaced from the first guide and are connected to the inner frame located in the cabinet, and wherein the insulating panel forms at least a portion of the front surface of the cabinet, the insulating panel being located opposite to the second guides with the inner frame located therebetween.

13. The refrigerator of claim 1, wherein the inner case includes:

a pair of sides;

a bottom connected to the pair of sides; and the insertion guide connected to the pair of sides or the bottom, the insertion guide being configured to surround an opening of the drink container, and wherein the cooling guide is coupled between the bottom and the insertion guide.

14. The refrigerator of claim 13, wherein a front surface of the insertion guide and an inner surface of the cabinet are spaced apart from each to define a mount space, and wherein the insertion guide has an extension extending toward a rear surface of the cabinet from the rear surface of the insertion guide to define an inlet, the extension being inclined such that the inlet widens the further the inlet is from the bottom.

15. The refrigerator of claim 1, wherein the cooling guide has a constant horizontal cross-section.

16. The refrigerator of claim 15, wherein the cooling guide defines at least a portion of the storage compartment by extending in a vertical direction, and wherein the cooler is located behind the cooling guide.

17. The refrigerator of claim 1, wherein the cooling guide is made of metal, wherein the cooler further includes a heat sink located opposite to the cooling block, and wherein the thermoelectric element is located between the heat sink and the cooling block.

18. The refrigerator of claim 1, wherein the insulating panel is located on a front surface of the cabinet and opposite to the cooler to define the storage compartment between the insulating panel and the cooler, the storage compartment being configured to store the drink container, and wherein the insulating panel surrounds at least a portion of the storage compaftment in cooperation with the cooling guide.

19. The refrigerator of claim 1, wherein the cabinet further includes a rear surface having an air intake port and an air discharge port, and wherein the refrigerator includes a spacer protruding outward from the rear surface of the cabinet.

* * * * *